US011831092B2

(12) United States Patent
Lu

(10) Patent No.: US 11,831,092 B2
(45) Date of Patent: Nov. 28, 2023

(54) COMPACT ELECTRICAL CONNECTOR

(71) Applicant: Amphenol East Asia Ltd., Taoyuan (TW)

(72) Inventor: Lo-Wen Lu, Taoyuan (TW)

(73) Assignee: Amphenol East Asia Ltd., Taoyuan (TW)

( * ) Notice: Subject to any disclaimer, the term of this patent is extended or adjusted under 35 U.S.C. 154(b) by 151 days.

(21) Appl. No.: 17/386,203

(22) Filed: Jul. 27, 2021

(65) Prior Publication Data

US 2022/0037817 A1 Feb. 3, 2022

Related U.S. Application Data

(60) Provisional application No. 63/057,373, filed on Jul. 28, 2020.

(51) Int. Cl.

| | |
|---|---|
| ***H01R 13/627*** | (2006.01) |
| ***H01R 12/70*** | (2011.01) |
| ***H01R 12/71*** | (2011.01) |

(52) U.S. Cl.

CPC ..... *H01R 12/7005* (2013.01); *H01R 12/716* (2013.01); *H01R 13/6272* (2013.01)

(58) Field of Classification Search

CPC ..... H01R 12/7005; H01R 12/716; H01R 13/6272; H01R 12/7064; H01R 13/64;

(Continued)

(56) References Cited

U.S. PATENT DOCUMENTS

| | | | |
|---|---|---|---|
| 2,996,710 | A | 8/1961 | Pratt |
| 3,002,162 | A | 9/1961 | Garstang |

(Continued)

FOREIGN PATENT DOCUMENTS

| | | | |
|---|---|---|---|
| CN | 1179448 | C | 12/2004 |
| CN | 1799290 | A | 7/2006 |

(Continued)

OTHER PUBLICATIONS

U.S. Appl. No. 17/348,598, filed Jun. 15, 2021, Lu.

(Continued)

*Primary Examiner* — Abdullah A Riyami
*Assistant Examiner* — Nelson R. Burgos-Guntin
(74) *Attorney, Agent, or Firm* — Wolf, Greenfield & Sacks, P.C.

(57) ABSTRACT

An electrical connector includes a housing having a bottom and a wall bounding an opening adjacent the bottom, and a shell configured to encircle an outer surface of the wall. The shell may include: first shell corners configured to conform with first housing corners of the housing, second shell corners configured to be spaced apart from second housing corners of the housing in a first direction, a plurality of first portions configured to conform with the outer surface of the wall, and a plurality of second portions configured to be spaced apart from the outer surface of the wall. The first and second shell corners have a height greater than a maximum height of the housing. Such a connector may be miniaturized, yet provide for robust operation and resist unintentional demating as a result of twisting forces on a plug inserted into the connector.

28 Claims, 15 Drawing Sheets

(58) Field of Classification Search
CPC .... H01R 13/6581; H01R 13/40; H01R 13/46; H01R 13/631; H01R 24/00
See application file for complete search history.

(56) References Cited

U.S. PATENT DOCUMENTS 3,134,950 A 5/1964 Cook
3,322,885 A 5/1967 May et al.
3,786,372 A 1/1974 Epis et al.
3,825,874 A 7/1974 Peverill
3,863,181 A 1/1975 Glance et al.
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,751,479 A 6/1988 Parr
4,761,147 A 8/1988 Gauthier
4,806,107 A 2/1989 Arnold et al.
4,846,724 A 7/1989 Sasaki et al.
4,846,727 A 7/1989 Glover et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,013,262 A 5/1991 Shibano
5,030,140 A 7/1991 Sugiyama
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,746,622 A * 5/1998 Consoli ..... H01R 13/5213 439/910
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,293,827 B1 9/2001 Stokoe
6,296,496 B1 10/2001 Trammel
6,299,438 B1 10/2001 Sahagian et al.
6,299,483 B1 10/2001 Cohen et al.
6,328,601 B1 12/2001 Yip et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,565,390 B2 5/2003 Wu
6,579,116 B2 6/2003 Brennan et al.
6,582,244 B2 6/2003 Fogg et al.
6,595,802 B1 7/2003 Watanabe et al.
6,602,095 B2 8/2003 Astbury, Jr. et al.
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 11/2004 Stokoe et al.
6,830,489 B2 12/2004 Aoyama
6,872,085 B1 3/2005 Cohen et al.
6,902,432 B2 * 6/2005 Morikawa ..... H01R 13/6275 439/607.41
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,226,314 B2 * 6/2007 Lang ..... H01R 13/6582 439/607.04
7,285,018 B2 10/2007 Kenny et al.
7,303,438 B2 * 12/2007 Dawiedczyk ..... H01R 12/7023 439/607.53
7,335,063 B2 2/2008 Cohen et al.
7,344,409 B2 * 3/2008 Lang ..... H01R 12/7005 439/372
7,410,365 B2 * 8/2008 Wu ..... H01R 13/512 439/76.1
7,491,089 B2 * 2/2009 Lang ..... H01R 12/7005 439/358
7,494,383 B2 2/2009 Cohen et al.
7,540,781 B2 6/2009 Kenny et al.
7,581,990 B2 9/2009 Kirk et al.
7,588,464 B2 9/2009 Kim
7,699,644 B2 4/2010 Szczesny et al.
7,722,401 B2 5/2010 Kirk et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,794,278 B2 9/2010 Cohen et al.
7,806,729 B2 10/2010 Nguyen et al.
7,862,378 B1 1/2011 Wan et al.
7,874,873 B2 1/2011 Do et al.
7,887,371 B2 2/2011 Kenny et al.
7,887,379 B2 2/2011 Kirk
7,906,730 B2 3/2011 Atkinson et al.

(56) References Cited

U.S. PATENT DOCUMENTS 7,914,304 B2 3/2011 Cartier et al.
7,985,097 B2 7/2011 Gulla
8,083,553 B2 12/2011 Manter et al.
8,182,289 B2 5/2012 Stokoe et al.
8,215,968 B2 7/2012 Cartier et al.
8,216,001 B2 7/2012 Kirk
8,257,095 B2 9/2012 Akai et al.
8,272,877 B2 9/2012 Stokoe et al.
8,348,701 B1 1/2013 Lan et al.
8,371,875 B2 2/2013 Gailus
8,382,524 B2 2/2013 Khilchenko et al.
8,439,706 B2 * 5/2013 Sytsma ..... H01R 13/6582 439/607.19
8,454,381 B2 * 6/2013 Wu ..... H01R 24/60 439/352
8,657,627 B2 2/2014 McNamara et al.
8,715,003 B2 5/2014 Buck et al.
8,771,016 B2 7/2014 Atkinson et al.
8,864,521 B2 10/2014 Atkinson et al.
8,926,377 B2 1/2015 Kirk et al.
8,944,831 B2 2/2015 Stoner et al.
8,998,642 B2 4/2015 Manter et al.
9,004,942 B2 4/2015 Paniauqa
9,022,806 B2 5/2015 Cartier, Jr. et al.
9,028,281 B2 5/2015 Kirk et al.
9,124,009 B2 9/2015 Atkinson et al.
9,219,335 B2 12/2015 Atkinson et al.
9,225,085 B2 12/2015 Cartier, Jr. et al.
9,300,074 B2 3/2016 Gailus
9,450,344 B2 9/2016 Cartier, Jr. et al.
9,484,674 B2 11/2016 Cartier, Jr. et al.
9,509,101 B2 11/2016 Cartier, Jr. et al.
9,520,689 B2 12/2016 Cartier, Jr. et al.
9,559,467 B1 * 1/2017 Khorrami ..... H01R 13/6581
9,742,132 B1 8/2017 Hsueh
9,972,945 B1 5/2018 Huang et al.
10,079,449 B1 * 9/2018 Chien ..... H01R 25/003
10,096,944 B2 * 10/2018 Huang ..... H01R 13/64
10,122,129 B2 11/2018 Milbrand, Jr. et al.
10,236,605 B1 * 3/2019 Henry ..... H01R 12/732
10,243,304 B2 3/2019 Kirk et al.
10,270,191 B1 4/2019 Li et al.
10,283,910 B1 5/2019 Chen et al.
10,348,040 B2 7/2019 Cartier, Jr. et al.
10,381,767 B1 8/2019 Milbrand, Jr. et al.
10,601,181 B2 3/2020 Lu et al.
10,777,921 B2 9/2020 Lu et al.
10,868,387 B2 * 12/2020 Hsiao ..... H01R 24/60
10,886,649 B1 1/2021 Yang et al.
11,128,092 B2 9/2021 Yang et al.
11,146,025 B2 10/2021 Lu et al.
11,171,445 B1 * 11/2021 Shen ..... H01R 13/502
11,189,971 B2 11/2021 Lu
11,289,850 B2 3/2022 Faith
11,303,065 B2 * 4/2022 Wang ..... H01R 12/71
11,569,613 B2 1/2023 Lu
2001/0042632 A1 11/2001 Manov et al.
2002/0042223 A1 4/2002 Belopolsky et al.
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2002/0146926 A1 10/2002 Fogg et al.
2004/0005815 A1 1/2004 Mizumura et al.
2004/0020674 A1 2/2004 McFadden et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0070160 A1 3/2005 Cohen et al.
2005/0095913 A1 * 5/2005 Fan ..... H01R 13/658 439/607.35
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0068640 A1 3/2006 Gailus
2006/0160399 A1 * 7/2006 Dawiedczyk ..... H01R 12/727 439/374
2006/0255876 A1 11/2006 Kushta et al.
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0170357 A1 * 7/2009 Yamashita ..... H01R 12/707 439/157
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2010/0048058 A1 2/2010 Morgan et al.
2010/0055984 A1 * 3/2010 Tsuchida ..... H01R 12/716 439/626
2010/0062650 A1 * 3/2010 Nakamura ..... H01R 13/64 439/65
2010/0081302 A1 4/2010 Atkinson et al.
2010/0203772 A1 8/2010 Mao et al.
2010/0294530 A1 11/2010 Atkinson et al.
2011/0003509 A1 1/2011 Gailus
2011/0067237 A1 3/2011 Cohen et al.
2011/0104948 A1 5/2011 Girard, Jr. et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0156938 A1 * 6/2012 Zhang ..... H01R 13/6461 439/660
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0078870 A1 3/2013 Milbrand, Jr.
2013/0090001 A1 4/2013 Kagotani
2013/0109232 A1 5/2013 Paniaqua
2013/0196553 A1 8/2013 Gailus
2013/0217263 A1 8/2013 Pan
2013/0225006 A1 8/2013 Khilchenko et al.
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0057498 A1 2/2014 Cohen
2014/0273557 A1 9/2014 Cartier, Jr. et al.
2014/0273627 A1 9/2014 Cartier, Jr. et al.
2014/0377992 A1 12/2014 Chang et al.
2015/0056856 A1 2/2015 Atkinson et al.
2015/0111427 A1 4/2015 Foxconn
2015/0236451 A1 8/2015 Cartier, Jr. et al.
2015/0236452 A1 8/2015 Cartier, Jr. et al.
2015/0255926 A1 9/2015 Paniagua
2016/0149343 A1 5/2016 Atkinson et al.
2017/0352970 A1 12/2017 Liang et al.

(56) References Cited

U.S. PATENT DOCUMENTS

| | | | | |
|---|---|---|---|---|
| 2018/0062323 | A1 | 3/2018 | Kirk et al. | |
| 2018/0145438 | A1 | 5/2018 | Cohen | |
| 2018/0205177 | A1 | 7/2018 | Zhou et al. | |
| 2018/0212376 | A1 | 7/2018 | Wang et al. | |
| 2018/0219331 | A1 | 8/2018 | Cartier, Jr. et al. | |
| 2018/0269607 | A1 | 9/2018 | Wu et al. | |
| 2019/0052019 | A1 | 2/2019 | Huang et al. | |
| 2019/0067854 | A1 | 2/2019 | Ju et al. | |
| 2019/0140385 | A1* | 5/2019 | Huo | H01R 13/506 |
| 2019/0173209 | A1 | 6/2019 | Lu et al. | |
| 2019/0173232 | A1* | 6/2019 | Lu | H01R 13/6594 |
| 2019/0267760 | A1* | 8/2019 | Chen | H01R 24/60 |
| 2020/0076132 | A1* | 3/2020 | Yang | H01R 12/73 |
| 2020/0203867 | A1* | 6/2020 | Lu | H01R 13/26 |
| 2020/0259294 | A1* | 8/2020 | Lu | H01R 12/57 |
| 2020/0266584 | A1 | 8/2020 | Lu | |
| 2020/0321727 | A1* | 10/2020 | Li | H01R 13/6275 |
| 2020/0335914 | A1* | 10/2020 | Hsu | H01R 12/716 |
| 2020/0366019 | A1* | 11/2020 | Hsiao | H01R 12/774 |
| 2021/0075159 | A1* | 3/2021 | Wang | H01R 13/6582 |
| 2021/0135404 | A1* | 5/2021 | Jiang | H01R 13/6582 |
| 2021/0399451 | A1* | 12/2021 | Lu | H01R 43/20 |
| 2022/0037817 | A1* | 2/2022 | Lu | H01R 13/6581 |
| 2022/0077632 | A1* | 3/2022 | Chen | H01R 13/64 |
| 2022/0115799 | A1* | 4/2022 | Tanaka | H01R 12/716 |
| 2022/0200208 | A1* | 6/2022 | Tseng | H01R 12/716 |
| 2022/0255261 | A1 | 8/2022 | Yang et al. | |
| 2022/0336999 | A1* | 10/2022 | Lu | H01R 13/516 |
| 2022/0360016 | A1* | 11/2022 | Lu | H01R 24/60 |
| 2022/0368077 | A1* | 11/2022 | Little | H01R 13/516 |
| 2023/0013147 | A1* | 1/2023 | Lu | H01R 12/727 |
| 2023/0052621 | A1* | 2/2023 | Little | H01R 13/6272 |
| 2023/0178931 | A1 | 6/2023 | Lu | |

FOREIGN PATENT DOCUMENTS

| | | | |
|---|---|---|---|
| CN | 101176389 | A | 5/2008 |
| CN | 101600293 | A | 12/2009 |
| CN | 101790818 | A | 7/2010 |
| CN | 101120490 | B | 11/2010 |
| CN | 201846527 | U | 5/2011 |
| CN | 102239605 | A | 11/2011 |
| CN | 101600293 | B | 5/2012 |
| CN | 102598430 | A | 7/2012 |
| CN | 202395248 | U | 8/2012 |
| CN | 104409906 | A | 3/2015 |
| CN | 304240766 | S | 8/2017 |
| CN | 304245430 | S | 8/2017 |
| CN | 206712089 | U | 12/2017 |
| CN | 207677189 | U | 7/2018 |
| CN | 110729594 | A | 1/2020 |
| CN | 209963304 | U | 1/2020 |
| CN | 210111108 | U | 2/2020 |
| CN | 111196014 | A | 5/2020 |
| CN | 210723480 | U | 6/2020 |
| CN | 211655155 | U | 10/2020 |
| CN | 212571495 | U | 2/2021 |
| CN | 212968224 | U | 4/2021 |
| CN | 112952423 | A | 6/2021 |
| CN | 306646962 | S | 6/2021 |
| CN | 306646976 | S | 6/2021 |
| CN | 306647993 | S | 6/2021 |
| CN | 215184605 | U | 12/2021 |
| CN | 215299556 | U | 12/2021 |
| DE | 60216728 | T2 | 11/2007 |
| EP | 1 018 784 | A1 | 7/2000 |
| EP | 1 779 472 | A1 | 5/2007 |
| EP | 2 169 770 | A2 | 3/2010 |
| EP | 2 405 537 | A1 | 1/2012 |
| GB | 1272347 | A | 4/1972 |
| JP | H07-302649 | A | 11/1995 |
| JP | 2001-510627 | A | 7/2001 |
| JP | 2006-344524 | A | 12/2006 |
| MX | 9907324 | A1 | 8/2000 |
| TW | 534482 | U | 5/2003 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| TW | M579828 | U | 6/2019 |
| TW | M583642 | U | 9/2019 |
| TW | M595343 | U | 5/2020 |
| TW | 202211556 | A | 3/2022 |
| TW | 202220301 | A | 5/2022 |
| TW | D223498 | S | 2/2023 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A2 | 10/2008 |
| WO | WO 2010/030622 | A1 | 3/2010 |
| WO | WO 2010/039188 | A1 | 4/2010 |
| WO | WO 2017/007429 | A1 | 1/2017 |

OTHER PUBLICATIONS

U.S. Appl. No. 17/365,465, filed Jul. 1, 2021, Lu.
EP 11166820.8, Jan. 24, 2012, Extended European Search Report.
PCT/CN2017/108344, Aug. 1, 2018, International Search Report and Written Opinion.
PCT/US2005/034605, Jan. 26, 2006, International Search Report and Written Opinion.
PCT/US2006/025562, Oct. 31, 2007, International Search Report with Written Opinion.
PCT/US2010/056482, May 24, 2012, International Preliminary Report on Patentability.
PCT/US2010/056482, Mar. 14, 2011, International Search Report and Written Opinion.
PCT/US2011/026139, Sep. 7, 2012, International Preliminary Report on Patentability.
PCT/US2011/026139, Nov. 22, 2011, International Search Report and Written Opinion.
PCT/US2011/034747, Jul. 28, 2011, International Search Report and Written Opinion.
PCT/US2012/023689, Aug. 15, 2013, International Preliminary Report on Patentability.
PCT/US2012/023689, Sep. 12, 2012, International Search Report and Written Opinion.
PCT/US2012/060610, Mar. 29, 2013, International Search Report and Written Opinion.
PCT/US2015/012463, May 13, 2015, International Search Report and Written Opinion.
PCT/US2017/047905, Dec. 4, 2017, International Search Report and Written Opinion.
Extended European Search Report for European Application No. EP 11166820.8 dated Jan. 24, 2012.
International Search Report and Written Opinion for International Application No. PCT/CN2017/108344 dated Aug. 1, 2018.
International Search Report with Written Opinion for International Application No. PCT/US2006/025562 dated Oct. 31, 2007.
International Search Report and Written Opinion for International Application No. PCT/US2005/034605 dated Jan. 26, 2006.
International Preliminary Report on Patentability for International Application No. PCT/US2010/056482 dated May 24, 2012.
International Search Report and Written Opinion for International Application No. PCT/US2010/056482 dated Mar. 14, 2011.
International Preliminary Report on Patentability for International Application No. PCT/US2011/026139 dated Sep. 7, 2012.

(56) References Cited

OTHER PUBLICATIONS

International Search Report and Written Opinion for International Application No. PCT/US2011/026139 dated Nov. 22, 2011.
International Search Report and Written Opinion for International Application No. PCT/US2011/034747 dated Jul. 28, 2011.
International Preliminary Report on Patentability for International Application No. PCT/US2012/023689 dated Aug. 15, 2013.
International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], SFF-TA-1016 Specification for Internal Unshielded High Speed Connector System. Rev 0.0.1. SNIA SFF TWG Technology Affiliate. Nov. 15, 2019. 40 pages.
Beaman, High Performance Mainframe Computer Cables. 1997 Electronic Components and Technology Conference. 1997;911-7.
Lu, Electrical Connector Having Symmetrical Docking Holes, U.S. Appl. No. 17/365,465, filed Jul. 1, 2021.
Shi et al. Improving Signal Integrity in Circuit Boards by Incorporating Absorbing Materials. 2001 Proceedings. 51st Electronic Components and Technology Conference, Orlando FL. 2001:1451-56.
U.S. Appl. No. 18/147,410, filed Dec. 28, 2022, Lu.

* cited by examiner

COMPACT ELECTRICAL CONNECTOR

CROSS-REFERENCE TO RELATED APPLICATIONS

The present application claims the benefit of priority of U.S. Provisional Application No. 63/057,373 filed Jul. 28, 2020, entitled "COMPACT ELECTRICAL CONNECTOR", the entire contents of which is incorporated by reference herein.

FIELD OF THE INVENTION

This disclosure relates generally to electrical interconnection systems and more specifically to compact electrical connectors.

BACKGROUND

Electrical connectors are used in many electronic systems. In general, various electronic devices (e.g., smart phones, tablet computers, desktop computers, notebook computers, digital cameras, and the like) have been provided with assorted types of connectors whose primary purpose is to enable an electronic device to exchange data, commands, and/or other signals with one or more other electronic devices. Electrical connectors are basic components needed to make some electrical systems functional. Signals (e.g., data, commands, and/or other electrical signals) often pass through electrical connectors to move between electronic devices, between components of an electronic device, and between multiple electronic devices that form an electronic system.

It is generally easier and more cost effective to manufacture an electronic system as separate assemblies, such as printed circuit boards ("PCBs"), which may be communicatively joined together with electrical connectors. In some scenarios, the PCBs to be joined may each have connectors mounted on them. The connectors may be mated together directly to interconnect the PCBs.

In other scenarios, the PCBs may be connected indirectly via a cable. Electrical connectors may nonetheless be used to make such connections. For example, the cable may be terminated on one or both ends with a plug type of electrical connector ("plug connector" herein). A PCB may be equipped with a receptacle type of electrical connector ("receptacle connector" herein) into which the plug connector may be inserted to connect the cable to the PCB. A similar arrangement may be used at the other end of the cable, to connect the cable to another PCB, so that signals may pass between the PCBs via the cable.

SUMMARY

According to an aspect of the present technology, an electrical connector is provided. The connector may include: a housing comprising a bottom and a wall bounding, at least in part, an opening adjacent the bottom; an island protruding from the bottom of the housing and into the opening; a plurality of terminals supported by the island; and a shell configured to encircle an outer surface of the wall. The shell may include: a pair of first shell corners configured to conform with a pair of first housing corners of the housing, a height of the first shell corners being greater than a maximum height of the housing; a pair of second shell corners configured to be spaced apart from a pair of second housing corners of the housing in a first direction, a height of the second shell corners being greater than the maximum height of the housing; a plurality of first portions configured to conform with the outer surface of the wall; a plurality of second portions configured to be spaced apart from the outer surface of the wall; and a plurality of hook portions configured to engage with an edge of the wall.

In some embodiments of this aspect, the wall of the housing may have first and second longer sections connected to first and second shorter sections. At least one of the first portions of the shell and at least one of the second portions of the shell may be located along the first longer section of the wall. At least one of the first portions of the shell and at least one of the second portions of the shell may be located along the second longer section of the wall. In an embodiment, a number of the at least one of the first portions of the shell located along the first longer section of the wall may be different from a number of the at least one of the second portions of the shell located along the first longer section of the wall. In an embodiment, a number of the at least one of the first portions of the shell located along the second longer section of the wall may be different from a number of the at least one of the second portions of the shell located along the second longer section of the wall.

In some embodiments of this aspect, a height of a portion of the shell on which the hook portions are located may be approximately equal to the maximum height of the housing.

In some embodiments of this aspect, each of the first and second shell corners may have a same height.

In some embodiments of this aspect, each of the first shell corners may have a first height, and each of the second shell corners may have a second height different from the first height.

In some embodiments of this aspect, the wall of the housing may have first and second longer sections connected to first and second shorter sections, and the pair of first housing corners may be adjacent the first longer section of the wall. In an embodiment, the shell may include a first section that joins a first of the first shell corners to a first of the second shell corners, the shell may include a second section that joins a second of the first shell corners to a second of the second shell corners, the first section of the shell may include a portion that conforms with the first shorter section of the wall, and the second section of the shell may include a portion that conforms with the second shorter section of the wall. In an embodiment, the first section of the shell may include a portion that faces a first space corresponding to one of the second portions of the shell, and the second section of the shell may include a portion that faces a second space corresponding to another one of the second portions of the shell. In an embodiment, a boundary of the first space may include a first one of the pair of second shell corners, and a boundary of the second space may include a second one of the pair of second shell corners. In an embodiment, each of the first and second sections of the shell may include an upper edge having a curved portion, and a height of the shell at the curved portions may be greater than the maximum height of the housing and less than the height of each of the first and second shell corners. In an embodiment, the shell may include a third section that joins the pair of first shell corners, the shell may include a fourth section that joins the pair of second shell corners, and a height of the third section may be greater than the maximum height of the housing. In an embodiment, the first portions of the shell may include a conforming portion that is part of the fourth section of the shell, and a height of the conforming portion of the fourth section of the shell may be the same as or within 10% of a height of a portion of the wall directly facing the conforming portion. In an embodiment, the hook portions may extend from an upper edge of the conforming portion of the fourth section of the shell.

In some embodiments of this aspect, the outer surface of the wall and the second portions of the shell may delimit a plurality of spaces configured to receive a plurality of plug portions of a plug connector therein when the plug connector is in a mating position with the electrical connector. In an embodiment, the spaces delimited by the second portions of the shell may be arranged such that the electrical connector has a single mating position with the plug connector. In an embodiment, the wall may include first and second longer sections separated from each other by first and second shorter sections to form a substantially rectangular outer boundary, and the spaces delimited by the second portions of the shell may include: a first space located along the first longer section of the wall, the first space having a length greater than about half a length of the first longer section in a second direction; and a plurality of second spaces located along the second longer section of the wall, each of the second spaces having a length less than about a quarter of a length of the second longer section in the second direction. In an embodiment, the first space may be configured to receive a bar-shaped portion of the plug connector, and each of the second spaces may be configured to receive a leg of the plug connector.

In some embodiments of this aspect, the shell may include a plurality of legs extending in away from the housing and configured to engage with a printed circuit board (PCB).

In some embodiments of this aspect, the edge of the wall may include a plurality of notches configured to engage with the hook portions of the shell.

According to another aspect of the present technology, an electrical connector is provided. The connector may include: an insulative housing comprised of a bottom and a wall extending from the bottom at a periphery of the bottom; and a shell configured to encircle an outer surface of the wall. The shell may include: a pair of first shell corners configured to conform with a pair of first housing corners of the housing, a height of the first shell corners being greater than a maximum height of the housing; a pair of second shell corners configured to be spaced apart from a pair of second housing corners of the housing in a first direction, a height of the second shell corners being greater than the maximum height of the housing; a plurality of first portions configured to conform with the outer surface of the wall; a plurality of second portions configured to be spaced apart from the outer surface of the wall; and a plurality of hook portions configured to engage with an edge of the wall.

In some embodiments of this aspect, each of the second portions of the shell may bound a space between the outer surface of the wall and the shell. Each of the spaces may be configured to receive a portion of a mating connector therein. In an embodiment, the wall may include first and second longer wall portions and first and second shorter wall portions. At least one of the spaces may be located along each of the first and second longer wall portions. A first section of the shell may conform with the outer surface of the wall at the first shorter wall portion. A minimum height of the first section may be greater than a maximum height of the housing. A second section of the shell may conform with the outer surface of the wall at the second shorter wall portion. A minimum height of the second section may be greater than the maximum height of the housing.

In some embodiments of this aspect, a number of the second portions of the shell located along the first longer wall portion may be different from a number of the second portions of the shell located along the second longer wall portion. In an embodiment, the spaces may be arranged such that the electrical connector has a single mating position with the mating connector. In an embodiment, the spaces may include: a first space located along the first longer wall portion, the first space having a length greater than about half a length of the first longer wall portion in a second direction; and a plurality of second spaces located along the second longer wall portion, each of the second spaces having a length less than about a quarter of a length of the second longer wall portion in the second direction.

In some embodiments of this aspect, a height of a portion of the shell on which the hook portions are located may be approximately equal to the maximum height of the housing.

In some embodiments of this aspect, each of the first and second shell corners may have a same height.

In some embodiments of this aspect, each of the first shell corners have a first height, and each of the second shell corners have a second height different from the first height.

In some embodiments of this aspect, the wall of the housing may have first and second longer sections connected to first and second shorter sections, and the pair of first housing corners may be adjacent the first longer section of the wall. In an embodiment, the shell may include a first section that joins a first of the first shell corners to a first of the second shell corners, the shell may include a second section that joins a second of the first shell corners to a second of the second shell corners, the first section of the shell may include a portion that conforms with the first shorter section of the wall, and the second section of the shell may include a portion that conforms with the second shorter section of the wall. In an embodiment, the first section of the shell may include a portion that faces a first space corresponding to one of the second portions of the shell, and the second section of the shell may include a portion that faces a second space corresponding to another one of the second portions of the shell. In an embodiment, a boundary of the first space may include a first one of the pair of second shell corners, and a boundary of the second space may include a second one of the pair of second shell corners. In an embodiment, each of the first and second sections of the shell may include an upper edge having a curved portion, and a minimum height of the shell at the curved portions may be greater than the maximum height of the housing and less than the height of each of the first and second shell corners. In an embodiment, the shell may include a third section that joins the pair of first shell corners, the shell may include a fourth section that joins the pair of second shell corners, and a height of the third section may be greater than the maximum height of the housing. In an embodiment, the first portions of the shell may include a conforming portion that is part of the fourth section of the shell, and a height of the conforming portion of the fourth section of the shell may be the same as or within 10% of a height of a portion of the wall directly facing the conforming portion.

According to some aspects of the present technology, a method of mating a plug connector and a receptacle connector is provided. The method may comprise aligning the plug connector with the receptacle connector by bringing the plug connector into a region delimited by four corners of a protruding structure extending from a shell of the receptacle connector, the protruding structure having a height corresponding to a maximum height of the receptacle connector, engaging a bar extending from the plug connector with a first space delimited by the shell of the receptacle connector and an outer surface of a first side of a housing wall of the receptacle connector, and engaging a pair of legs extending from the plug connector with a pair of second spaces delimited by the shell of the receptacle connector and an outer surface of a second side of the housing wall of the receptacle connector, wherein the second spaces are located at corners of the shell. The method also may comprise, after the aligning, pressing the plug connector towards the receptacle connector, and engaging a plurality of hook portions of the shell with a plurality of notches located at an upper edge of the wall. The first space may be located along a first side of the receptacle connector, the second spaces may be located along a second side of the receptacle connector opposite to the first side, and the mated position may be a single position in which the plug connector aligns with the receptacle connector.

In some embodiments of this aspect, the pressing of the plug connector towards the receptacle connector may be in a direction orthogonal to the housing bottom of the receptacle connector and orthogonal to a cavity bottom of the plug connector.

In some embodiments of this aspect, the wall may be comprised of the first and second longer wall portions and first and second shorter wall portions. A first section of the shell may conform with the outer surface of the wall at the first shorter wall portion, and a second section of the shell may conform with the outer surface of the wall at the second shorter wall portion. After the pressing, a minimum height of the first section of the shell may be greater than a maximum height of the housing, and a minimum height of the second section of the shell may be greater than the maximum height of the housing.

The foregoing features may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

DETAILED DESCRIPTION

Figure 1A:
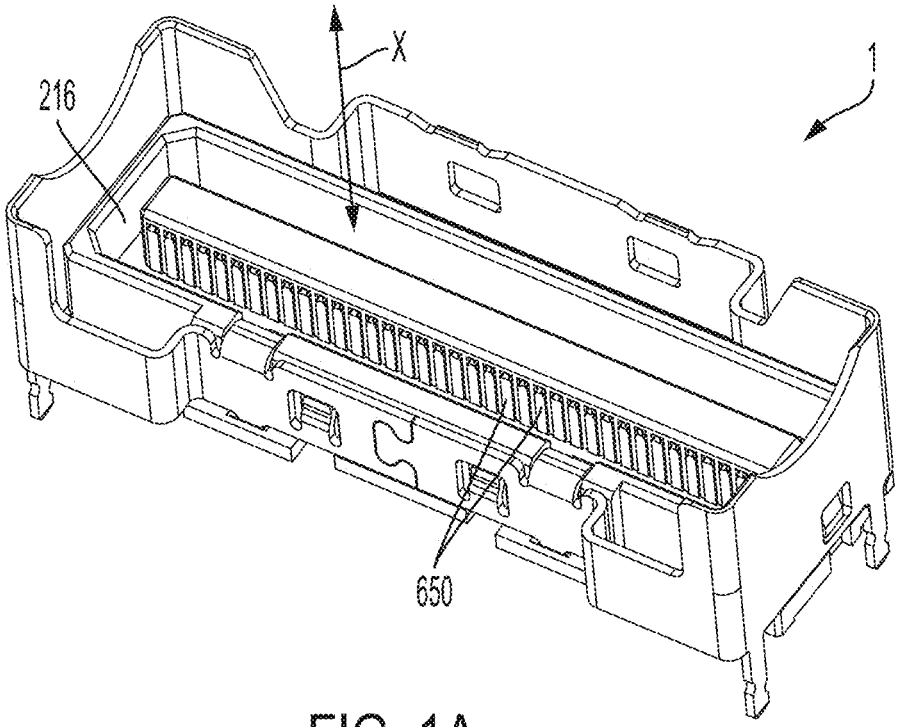
FIG. 1A shows a top front perspective view of an electrical connector, according to some embodiments of the present technology.

The inventors have recognized and appreciated design techniques for electrical connectors that enable mated plug and receptacle connectors to occupy a small volume while providing reliable operation for high-integrity signal interconnects. Techniques and technology described herein may lead to compact yet robust connectors, which are less likely to be damaged during mating and also less likely to be inadvertently disconnected after mating, enabling compact electronic devices having high performance that is reliable.

The inventors have further recognized and appreciated that miniaturized electrical connectors are more likely to be damaged by some forces compared with other forces that can arise during use, such as when the receptacle connector is mated with the plug connector. Although it may be preferred that, during mating of the plug and receptacle connectors, force be applied in a direction parallel to an axial direction of the receptacle connector, in practice, however, a user may not pay special attention to an angle at which the plug connector is oriented with respect to the receptacle connector. Thus, the receptacle connector may be subject to an external force that is not parallel to the axial direction of the receptacle connector. Such off-axis forces can impact the receptacle connector in ways that impact the integrity of signals passing through the receptacle connector. Off-axis forces, for example, may cause the receptacle connector to tilt. In some situations, the force may be sufficient to break solder joints connecting metal terminals of the receptacle connector to a PCB. In other scenarios, the off-axis forces may deform the terminals, shift their positions or otherwise alter the signal paths through the receptacle connector in ways that degrade the integrity of signals passing through the receptacle connector.

Damage may also result if the user attempts to press the plug connector into the receptacle connector with a wrong orientation of the plug connector or with the plug connector skewed or misaligned with the receptacle connector. For example, when a user attempts to insert a misaligned plug connector, the receptacle connector may be subject to a large force, such as 55N or more. In addition to the damage to the solder connections of the metal terminals, the force may be sufficient to deform or break one or more portions of an insulative housing of the receptacle connector, including a portion bounding a receiving portion intended to receive the plug connector. The receptacle connector may then cease to be able to hold the plug connector reliably, thus creating the possibility of intermittent disconnection between the plug and receptacle connectors. Consequently, the receptacle connector may lose its functionality and, in turn, normal operation of the electronic device employing the receptacle connector may cease.

These risks of damage are greater for miniaturized connectors, such as those with terminals spaced, center to center, at 0.6 mm or less, such as connectors with a terminal spacing of 0.5 mm or less, 0.4 mm or less, or 0.35 mm or less.

The inventors also have recognized that after the plug connector is properly mated with the receptacle connector, the mated connectors may experience forces that may cause them to be inadvertently disconnected. For example, a miniaturized receptacle connector as described herein may be mounted on a central portion of a PCB forming a server or other electronic assembly. In that way, a cable, terminated by a plug connector that is inserted into the receptacle may carry signals with low loss to the central portion of the PCB, near a processor or other component that operates on high frequency signals. The cable extending from the plug connector may be arranged inside an electronic device (e.g., a server) employing the receptacle connector such that the cable imparts a twisting force on the plug connector relative to the receptacle connector. Such a twisting force may be sufficient by itself, or in combination with external forces, to cause the plug connector to disconnect from the receptacle connector. The external forces may include, for example, regular jostling and handling by a user of the electronic assembly. As will be appreciated, inadvertent disconnection of the mated connectors after the electronic assembly has been fully assembled and deployed for use may waste significant resources to troubleshoot and fix.

Aspects of the techniques and technology described herein may reduce or eliminate the possibility of improper orientation of a plug connector during a mating operation with a receptacle connector. Aspects of the techniques and technology described herein may reduce or eliminate the possibility of misalignment between the plug and receptacle connectors. Aspects of the techniques and technology described herein may minimize or eliminate the application of damaging forces during a mating operation. Such aspects may be used separately or in combination in an electrical connector.

Figure 1B:
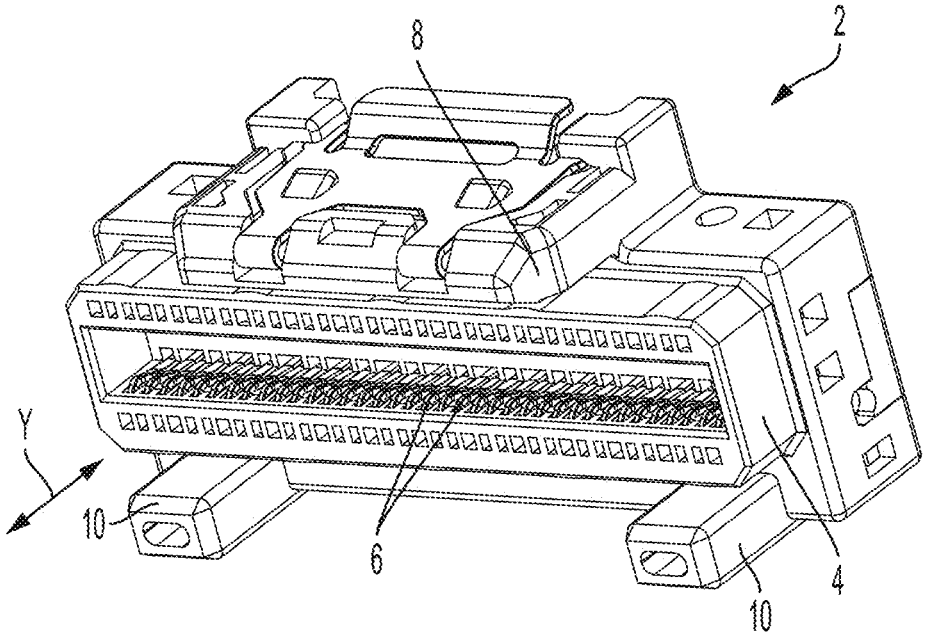
FIG. 1B shows a bottom rear perspective view of a plug connector that may be mated with the electrical connector of FIG. 1A.

Turning now to the figures, FIG. 1A shows an example of an electrical connector 1 according to some embodiments of the present technology. The connector 1 may be a receptacle connector configured to mate with a plug connector to form a mated pair. FIG. 1B shows a plug connector 2 generally of the type that may be mated with a connector generally of the type of the connector 1, although some dimensions of the plug connector 2 would need to be modified to have an exact or closer-to-exact fit with the connector 1, as discussed below. The mated pair may provide a low-profile connection between a PCB, to which the connector 1 may be attached, and cables extending from the plug connector 2. Such a PCB is not shown in the drawings but is known in the art. The plug connector 2 may be configured to engage with the connector 1 and disengage from the connector 1 along an axial direction X, represented by a doubled-headed arrow in FIG. 1A. The direction X may be perpendicular to a surface of the PCB.

For low profile applications, the plug connector 2 may be a right-angle plug connector, in which a cable extends from the plug connector 2 in a direction perpendicular to a mating direction Y of the plug connector 2, shown by the double-headed arrow in FIG. 1B. As will be appreciated, the cable may be a single-wire cable or a multi-wire cable. When fully engaged, the mated pair may have a low profile that is close to a mounting surface of the PCB. The low profile may be, for example, less than 15 mm in some embodiments, or less than or equal to 10 mm in some embodiments, or less than or equal to 5 mm in some embodiments.

If a low profile is not necessary or desired, the connector 1 may engage with a different type of plug connector. For example, the connector 1 may engage with a plug connector in which a cable extends parallel to the direction Y.

Figure 1C:
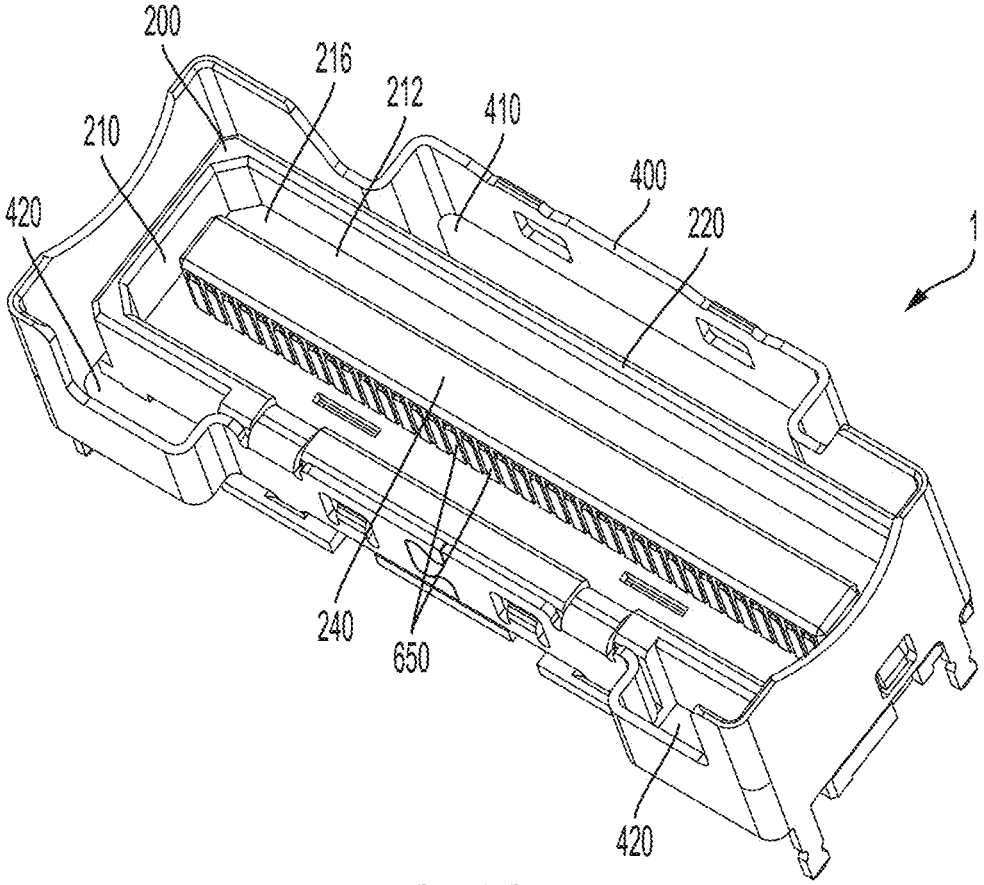
FIG. 1C shows another top front perspective view of the electrical connector of FIG. 1A.
Figure 1D:
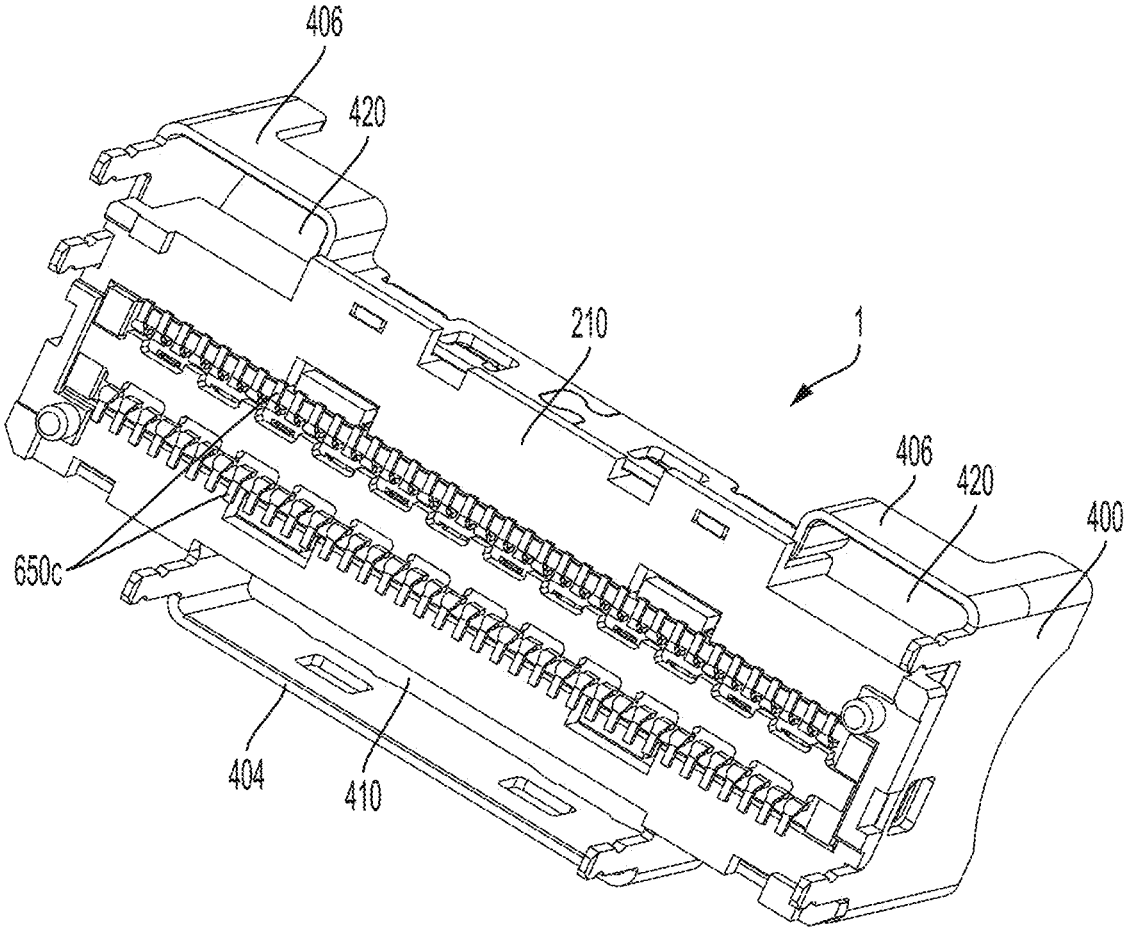
FIG. 1D shows a bottom front perspective view of the connector of FIG. 1A.
Figure 2A:
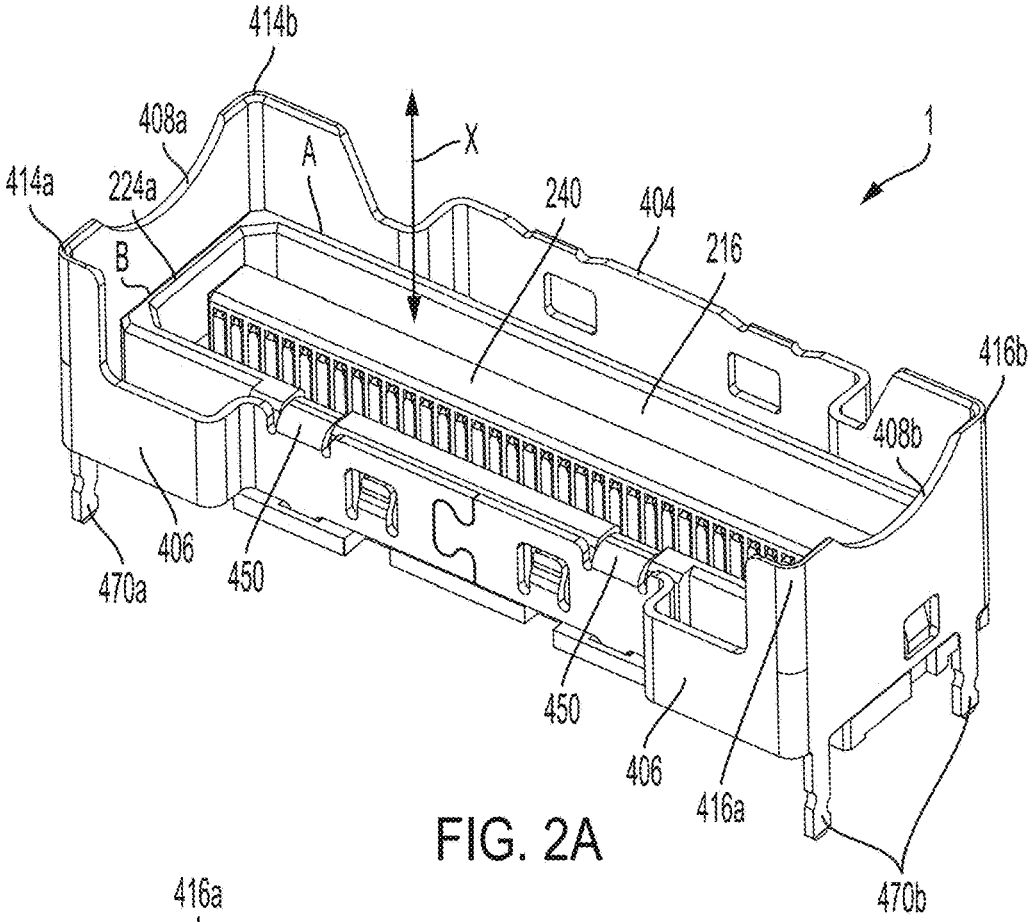
FIGS. 2A and 2B show top front and top rear perspective views, respectively, of the connector of FIG. 1A.
Figure 2B:
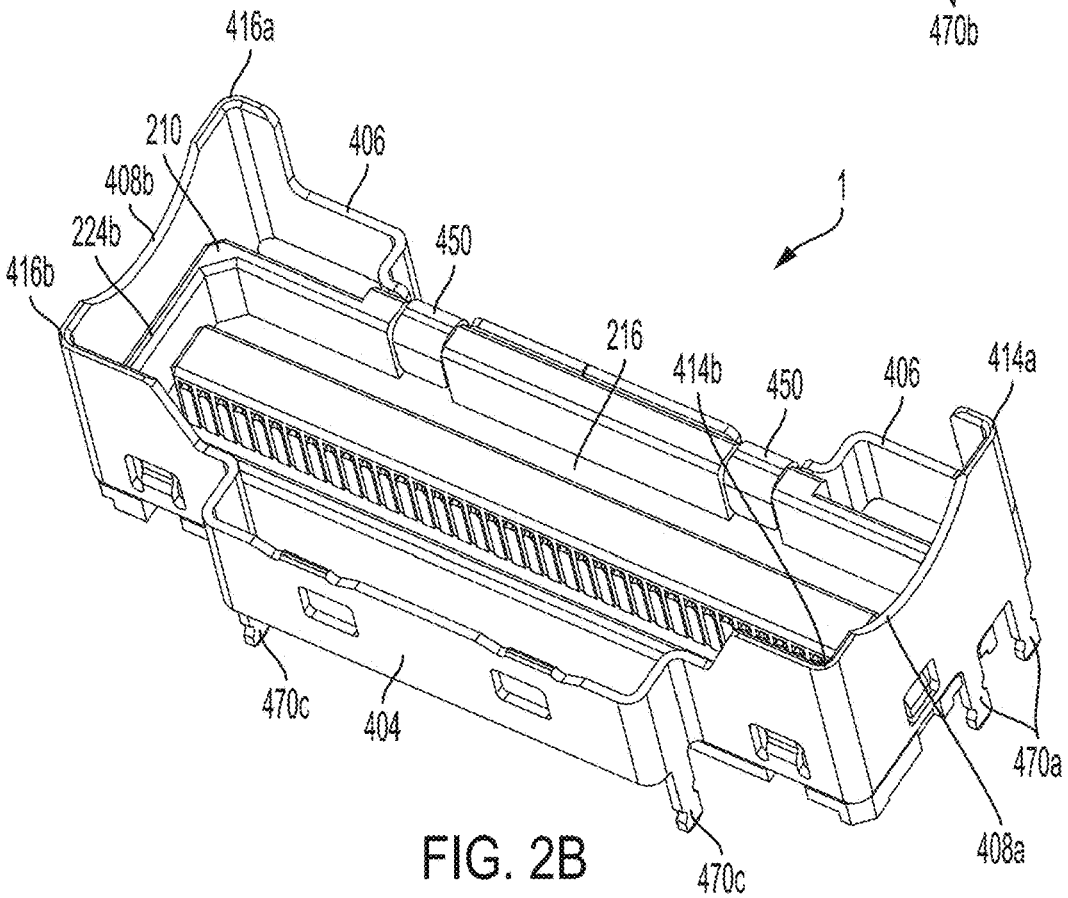
Figure 3A:
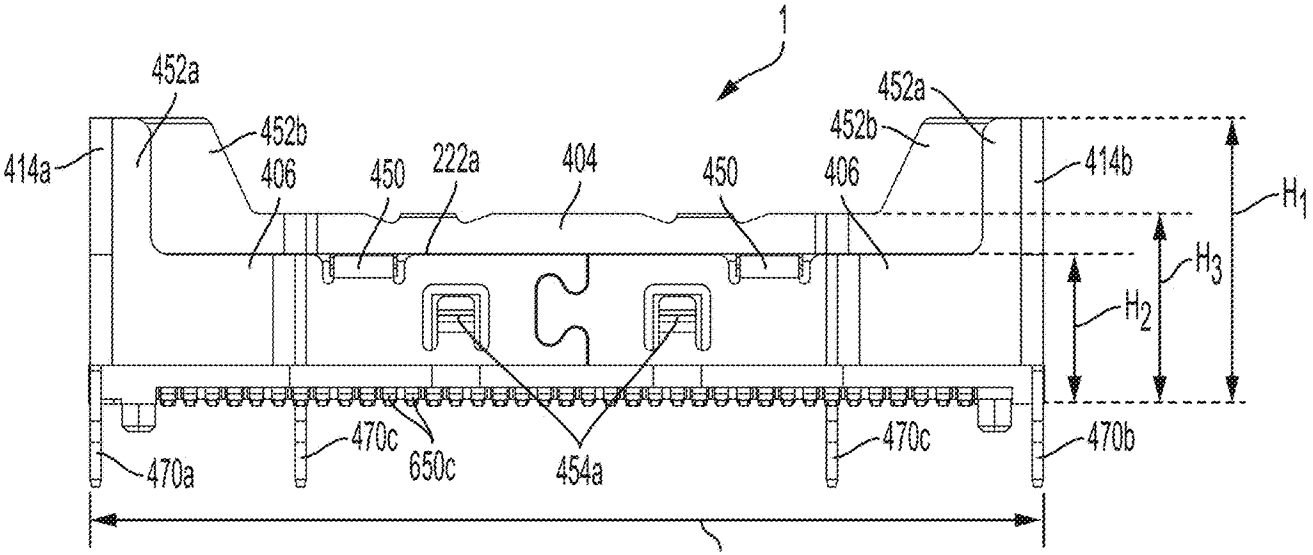
FIGS. 3A and 3B show front and rear elevational views, respectively, of the connector of FIG. 1A.
Figure 3B:
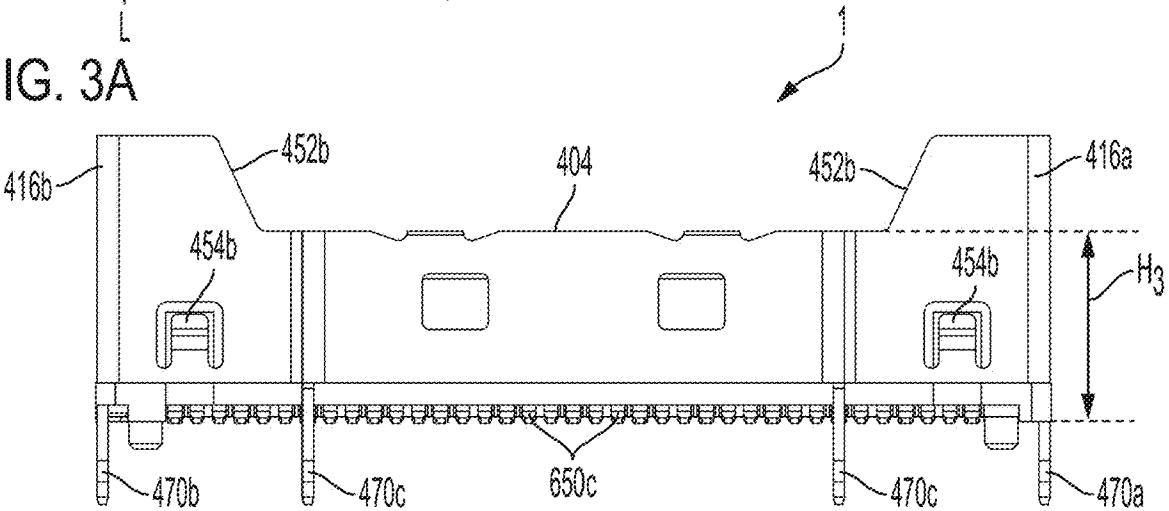
Figure 4B:
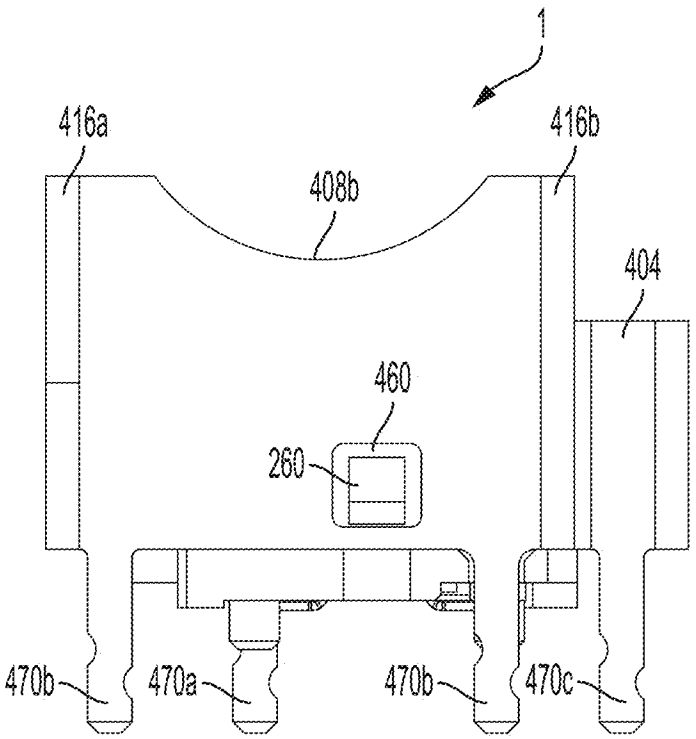
FIGS. 4A and 4B show left and right elevational views, respectively, of the connector of FIG. 1A.
Figure 4A:
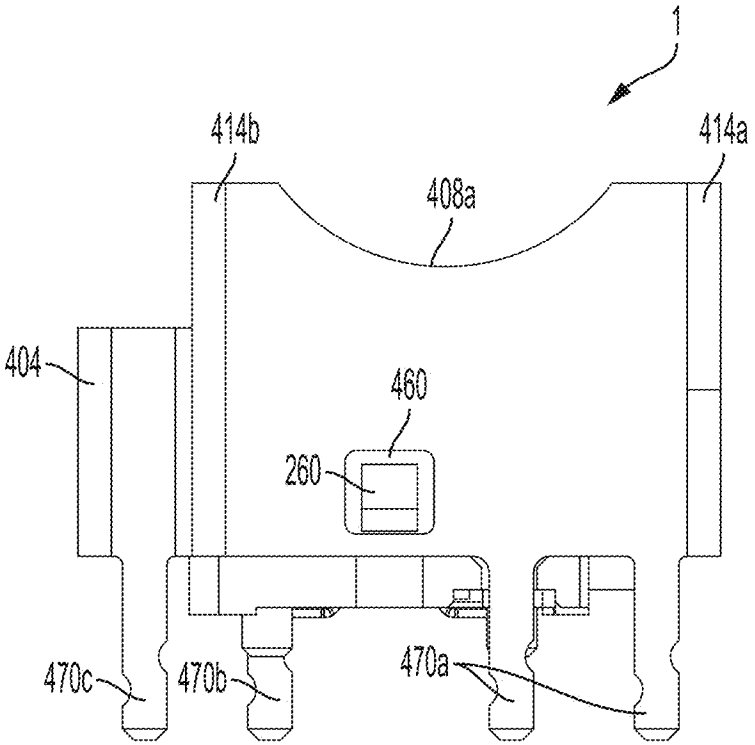
Figure 5A:
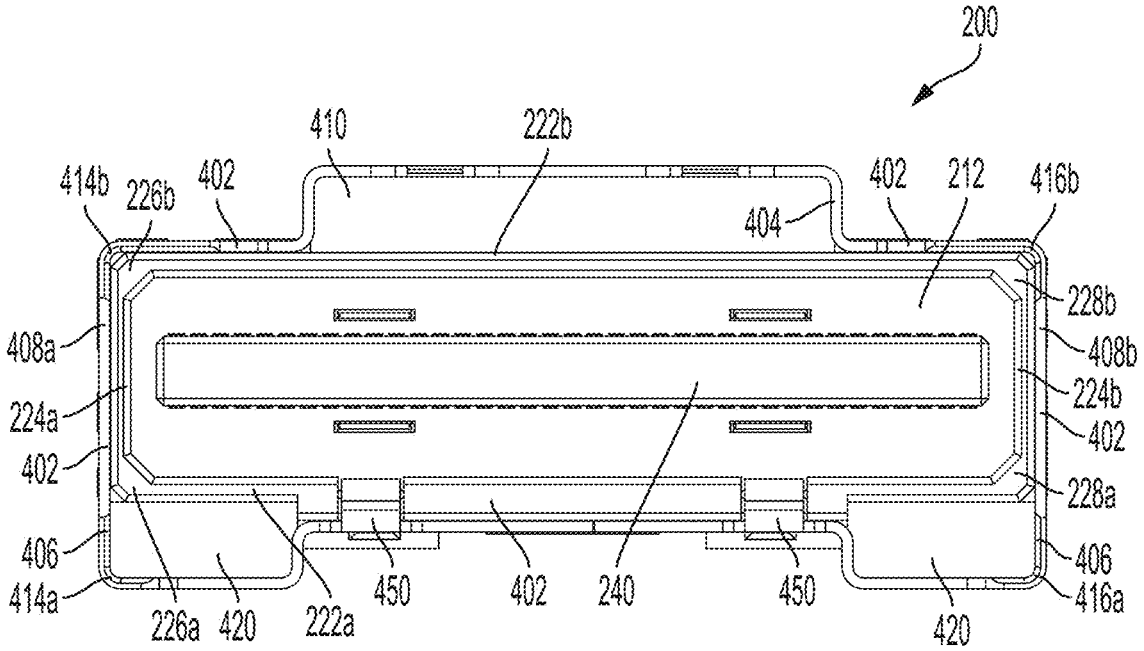
FIGS. 5A and 5B show top and bottom plan views, respectively, of the connector of FIG. 1A.
Figure 5B:
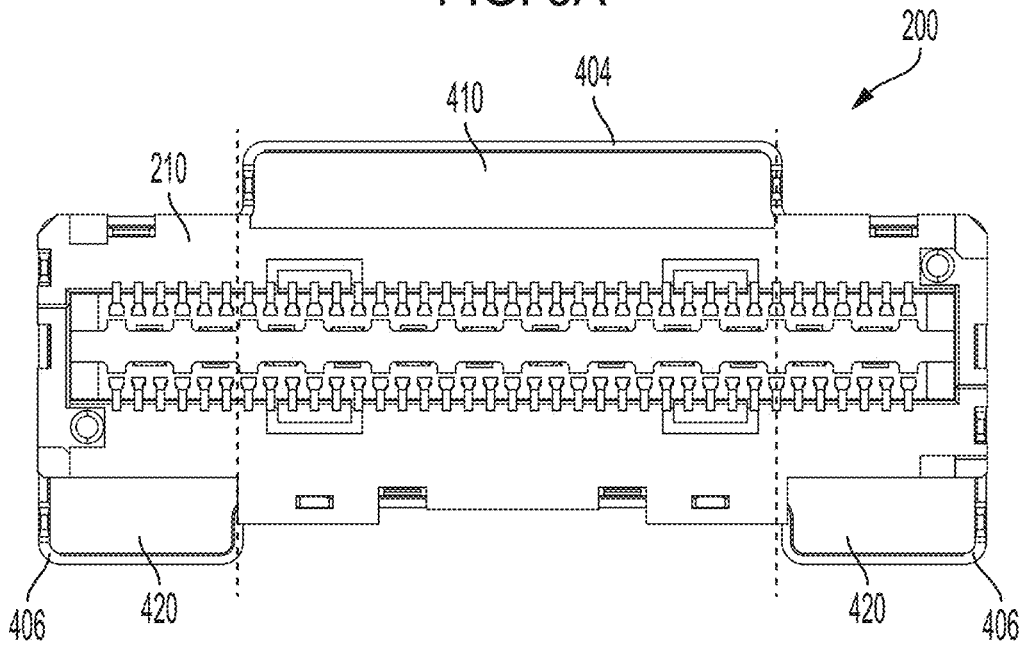
Figure 6:
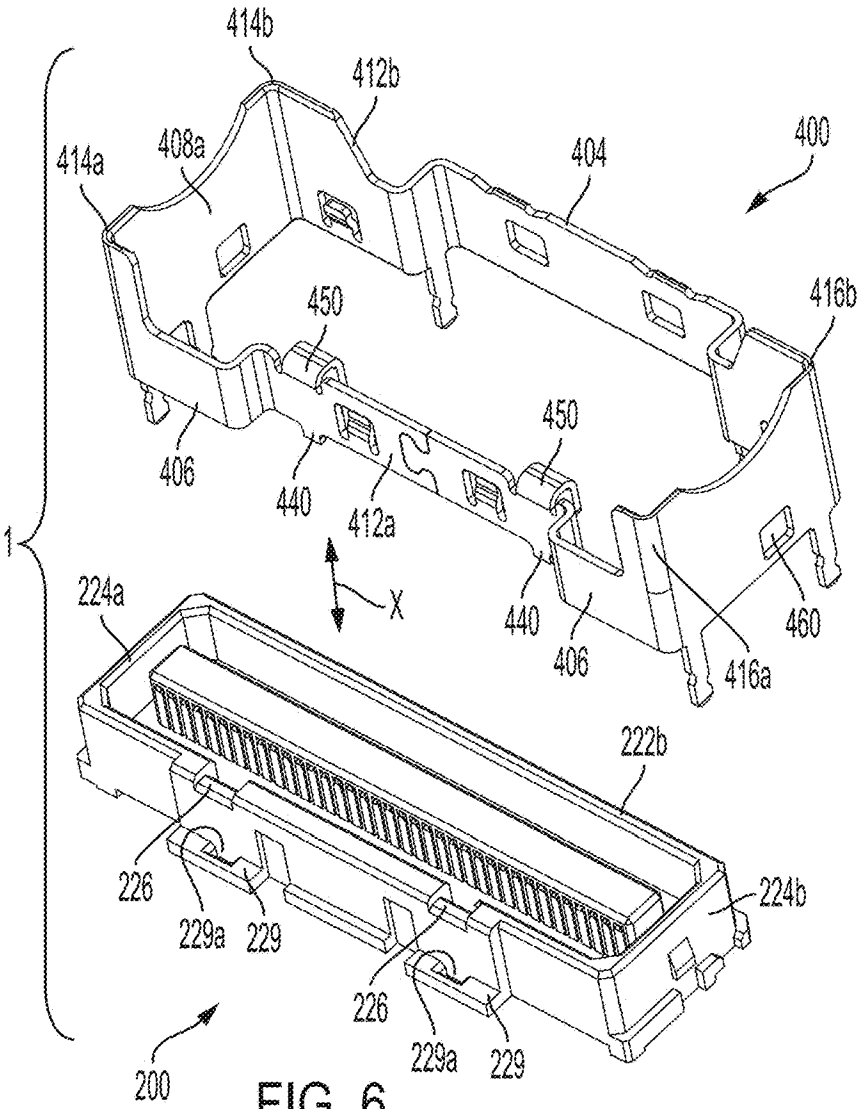
FIG. 6 shows a top front perspective view of the connector of FIG. 1A in a partially disassembled state.

Details of the connector 1, according to some embodiments of the present technology, may be found in the perspective views shown in FIGS. 1A, 1C, 1D, 2A, and 2B. Specifically, FIG. 1A shows a top front perspective view of the connector 1; FIG. 1C shows another top front perspective view of the connector 1; FIG. 1D shows a bottom front perspective view of the connector 1; and FIGS. 2A and 2B show top front and top rear perspective views, respectively, of the connector 1. Additionally, FIGS. 3A and 3B show front and rear elevational views, respectively, of the connector 1; FIGS. 4A and 4B show left and right elevational views, respectively, of the connector 1; FIGS. 5A and 5B show top and bottom plan views, respectively, of the connector 1; and FIG. 6 shows a top front perspective view of the connector 1 in a partially disassembled state.

The connector 1 may have a cavity 216 configured to receive a mating portion 4 of the plug connector 2. When the plug connector 2 is properly mated with the connector 1, terminals 650 of the connector 1, which may be exposed in the cavity 216, electrically contact corresponding terminals 6 in the plug connector 2, enabling signals to pass through the mated pair.

More specifically, mating of the plug connector 2 with the connector 1 may be achieved by moving the mating portion 4 of the plug connector 2 along the direction X into the cavity 216 of the connector 1. Proper mating may be achieved by aligning the plug connector 2 with the connector 1 such that the direction Y is coincident with direction X. In some embodiments of the present technology, both the direction Y and the direction X are perpendicular to the surface of the PCB during proper mating. Further, features of the plug connector 2 that receive corresponding features of the connector 1, and vice versa, are aligned when the directions Y and X are aligned as a common direction, such that relative motion of the plug connector 2 in the common direction brings these features into engagement. As described herein, the plug connector 2 and the connector 1 may provide features that align the connectors 1 and 2 for engagement by relative motion in the common direction (i.e., Y and X are the same), that avoid damage to one or both of the connectors 1 and 2 from force while the directions Y and X are misaligned, and that avoids inadvertent disconnection due to, e.g., twisting forces and/or external forces.

Figure 8A:
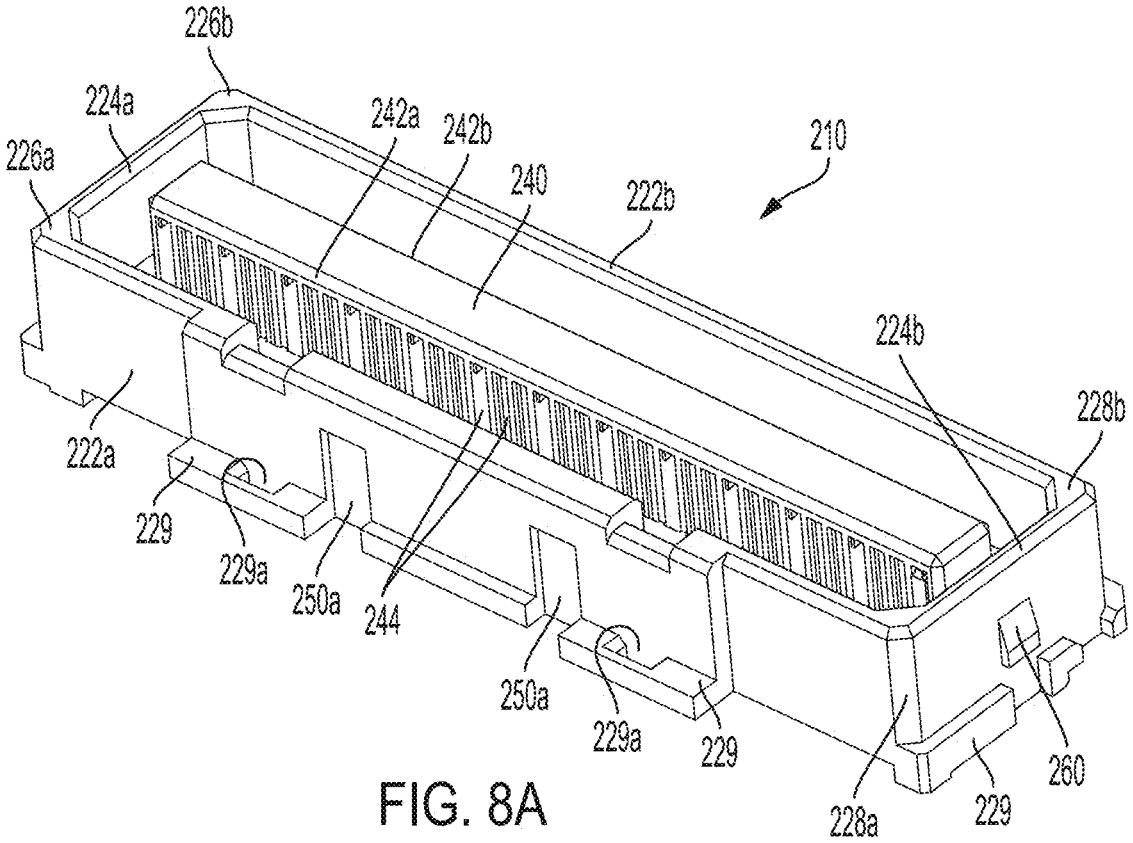
FIGS. 8A and 8B show top front and top rear perspective views, respectively, of a housing of the housing assembly of FIG. 7, according to some embodiments of the present technology.
Figure 8B:
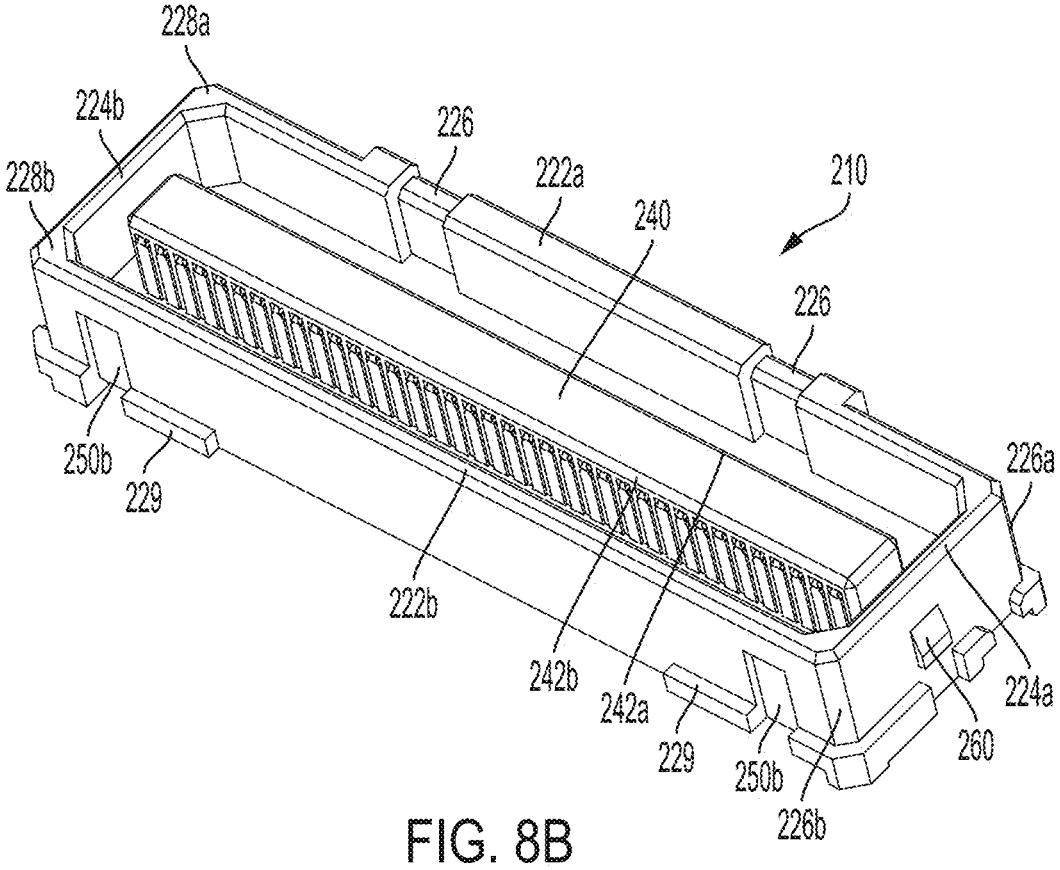

The connector 1 may include a housing assembly 200 and a shell 400. The housing assembly 200 may include an insulative housing 210 having a bottom 212 and a wall 220 extending from a periphery of the bottom 212. The bottom 212 and the wall 220 may define the cavity 216 of the housing 210. For example, the wall 220 may extend perpendicularly from the bottom 212 of the housing 210. The bottom 212 may have a generally rectangular shape, such that the wall 220 may have two longer segments 222*a*, 222*b* at front and rear sides of the connector 1, respectively, and two shorter segments 224*a*, 224*b* at left and right sides of the connector 1, respectively. FIGS. 8A and 8B show top front and top rear perspective views, respectively, of the housing 210.

Figure 7:
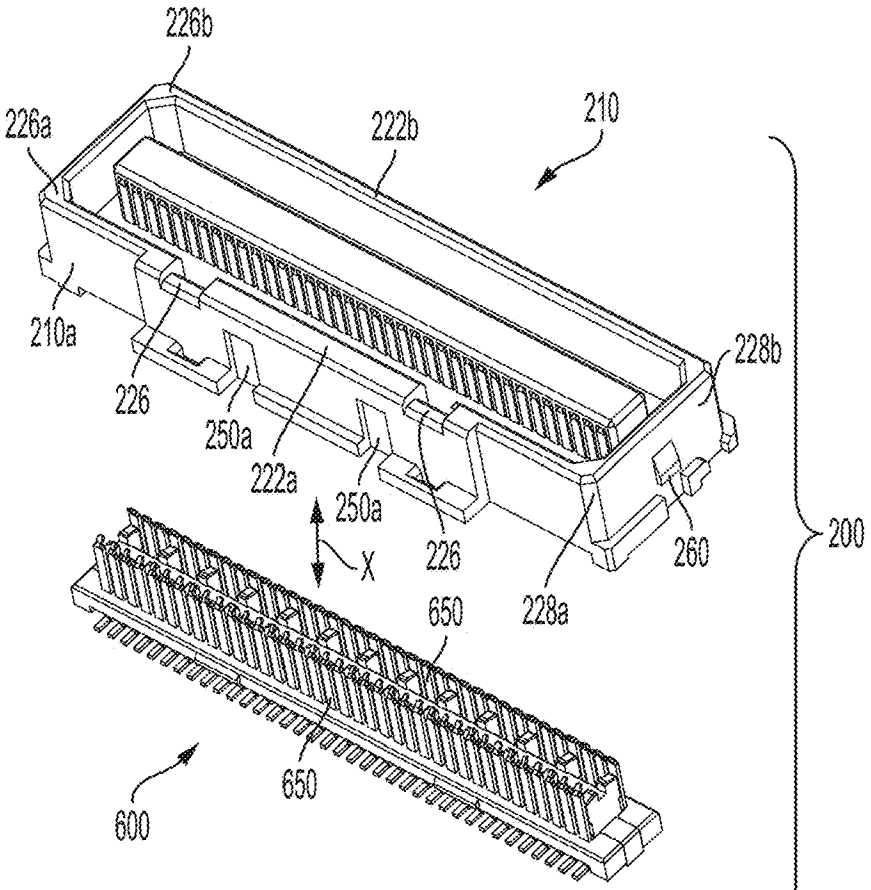
FIG. 7 shows a top front perspective view of a housing assembly of the connector of FIG. 1A in a partially disassembled state, according to some embodiments of the present technology.

FIG. 7 shows the housing assembly 200 in a partially disassembled state. The housing assembly 200 may include the housing 210 and a terminal assembly 600. An island 240 may extend from the bottom 212 into the cavity 216 of the housing 210. The island 240 may have a hollow interior and may be structured to accommodate the terminal assembly 600 in the hollow interior. The terminal assembly 600 may include a plurality of the terminals 650, which may include ground terminals and signal terminals, as discussed below. The island 240 may include two major surfaces 242*a*, 242*b* respectively facing the two longer segments 222*a*, 222*b* of the wall 220. One or both of the major surfaces 242*a*, 242*b* may include channels or slots 244 through which portions of the terminals 650 may be exposed.

An upper edge of the wall 220 of the housing 210 may include notched portions 226, which may engage with the shell 400, as describe below. The notched portions 226 may be located on one or both of the two longer segments 222*a*, 222*b* of the wall 220.

As shown in FIG. 2B, the cavity 216 of the housing 210 may have a longer dimension parallel to the longer segments 222*a*, 222*b* of the wall 220, and a shorter dimension orthogonal to the longer dimension and parallel to the shorter segments 224*a*, 224*b* of the wall 220. Optionally, guide posts (not shown) may extend from the bottom 212 of the housing 210 and may be configured to engaged with openings or recesses (not shown) in the plug connector 2. For example, the guide posts may be disposed in the housing 210 at or near diagonally opposite corners of the housing 210, respectively between diagonally opposite corners of the island 240 and diagonally opposite corners of the wall 220.

The shell 400 of the connector 1 may be configured to encircle an outer surface 210*a* of the housing 210. In some embodiments of the present technology, the shell 400 may be stamped from a sheet of metal that is formed into the shape illustrated in the drawings. Ends of that strip of metal are joined, such as by welding or brazing or via a mechanical attachment. In some embodiments, the shell 400 may fully encircle the housing 210, with portions of the shell 400 adjacent all sections of the wall 220 of the housing 210. In other embodiments, the shell 400 may have portions adjacent only some sections of the wall 220 of the housing 210 or only a portion of one section of the wall 220, so as to encircle only partially the housing 210.

As shown in FIGS. 6 and 8A, the housing 210 may include ledge portions 229 extending laterally from a lower edge of the housing 210. The ledge portions 229 may serve as supports on top of which a portion of the shell 400 sits when the housing 210 and the shell 400 are assembled together. The ledge portions 229 also may serve as stops to prevent the shell 400 from being pushed beyond a predetermined optimal position during an assembly process of placing the shell 400 around the housing 210. To prevent shifting of the shell 400 relative to the housing 210 during assembly, the ledge portions 229 may include holes or recesses 229*a* configured to receive positioning projections 440 extending from a lower edge of the shell 400. In some embodiments of the present technology the holes or recesses 229*a* are included in some but not all of the ledge portions 229 to, e.g., facilitate identification of a front side of the shell 400 and/or a front side of the housing 210.

Figure 9A:
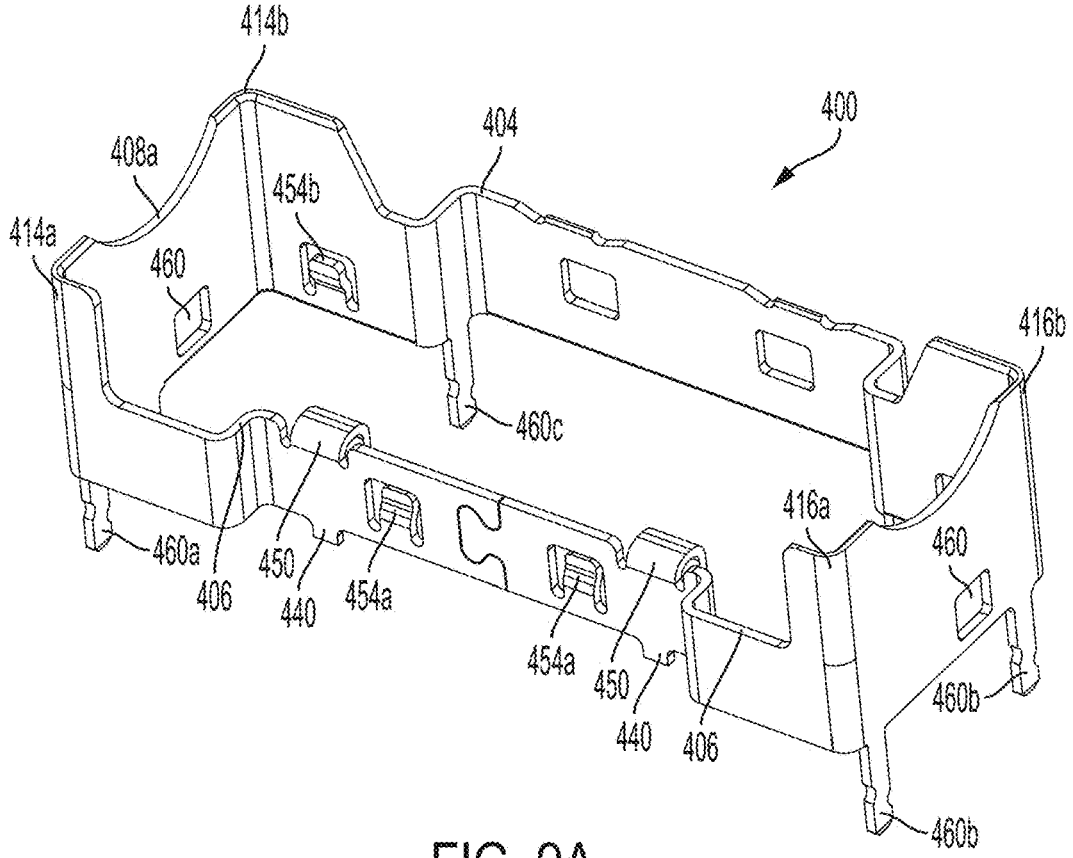
FIGS. 9A, 9B, and 9C show top front, top rear, and bottom left perspective views, respectively, of a shell of the housing assembly of FIG. 7, according to some embodiments of the present technology.
Figure 9B:
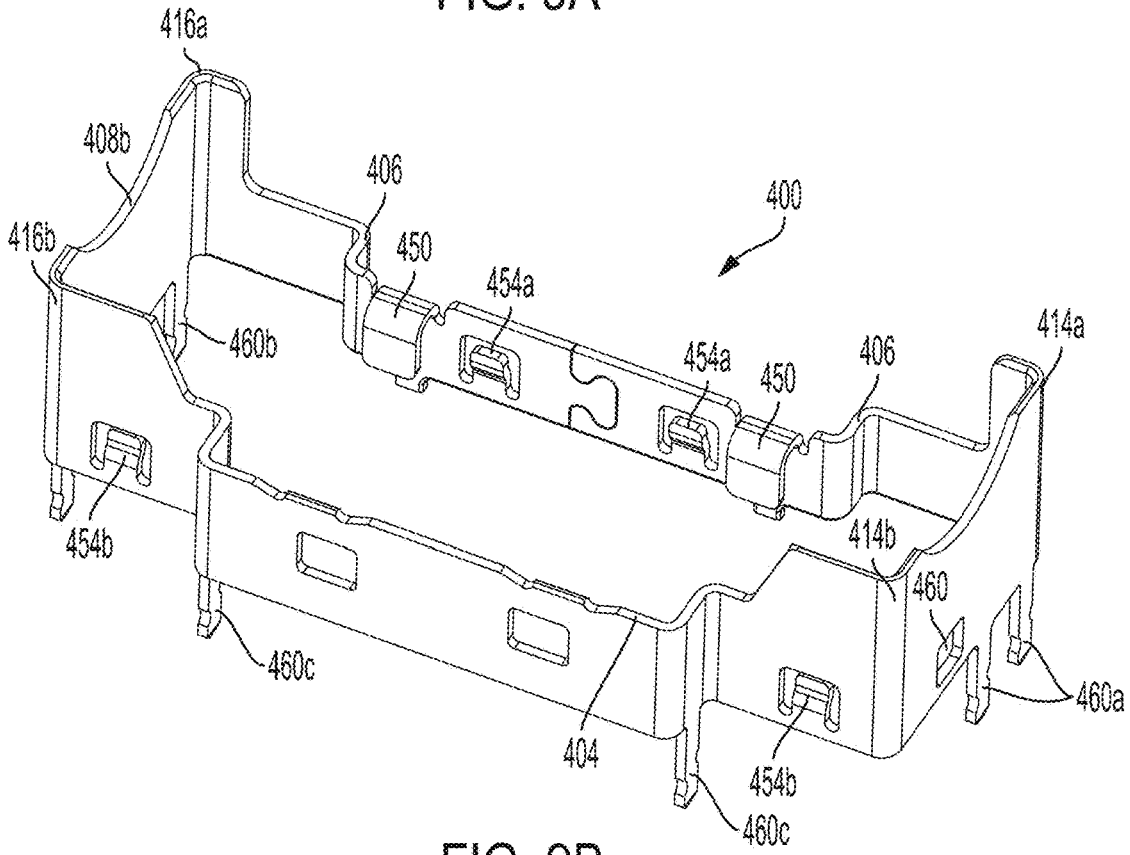
Figure 9C:
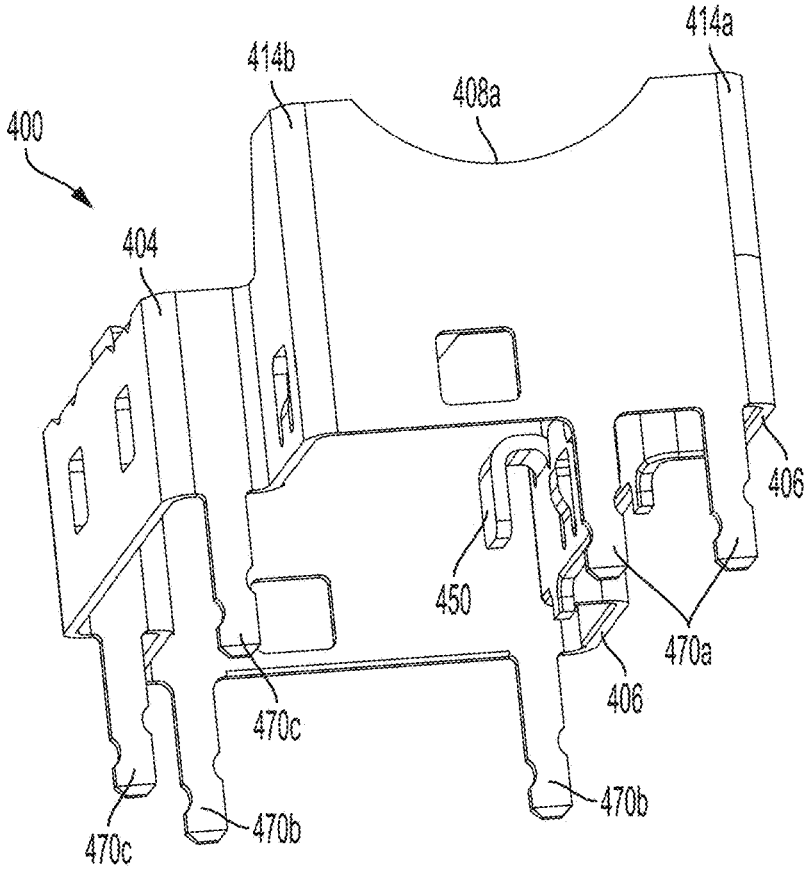
Figure 9D:
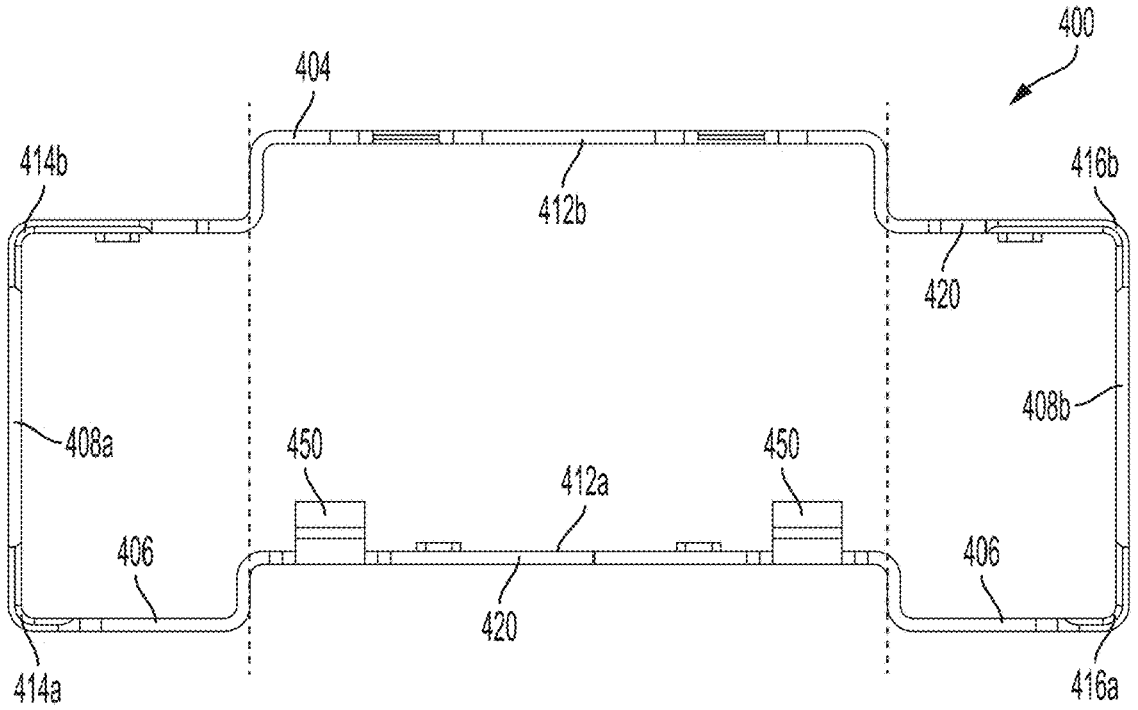
FIG. 9D shows a top plan view of the shell of FIGS. 9A, 9B, and 9C.

FIGS. 9A, 9B, and 9C show top front, top rear, and bottom left perspective views, respectively, of the shell 400. FIG. 9D shows a top plan view of the shell 400. According to some embodiments of the present technology, the shell 400 may include one or more conforming portions 402, each of which conforms with and is adjacent the outer surface 210*a* of the housing 210. The shell 400 also may include one or more spaced-apart portions 404, 406, each of which may be separated or spaced apart from the outer surface 210*a* of the housing 210 to define a space 410, 420 therebetween. In some embodiments, at least some of the conforming portions 402 of the shell 400 have a snug fit with the housing 210 when the housing 210 and the shell 400 are assembled together. For example, at regions A and B in FIG. 2A, there may be no gap between the housing 210 and the shell 400.

In some embodiments of the present technology, the shell 400 may have a spaced-apart portion 404 on one side (e.g., a rear side) and at least one spaced-apart portion 406 on an opposite side (e.g., a front side). The spaced-apart portions 404, 406 may be arranged such that no spaced apart portion on one side of the shell 400 is directly opposite another spaced apart portion on the opposite side of the shell. This configuration is schematically depicted by the dashed lines in FIGS. 5B and 9D, showing that no region of the space 410 on the rear side of the shell 400 is directly opposite a region of the spaces 420 on the front side. Additionally, in some embodiments, no part of the spaced-apart portion 404 on the rear side of the shell 400 is directly opposite any part of the spaced-apart portions 406 on the front side. Such a structure may facilitate a "blind" mating operation, where a user may not be able to see one or both of the connectors 1, 2 when mating the connectors 1, 2 together, by letting the user know that there is a misalignment before the user uses any force to push the connectors 1, 2 together. Optionally, the spaced-apart portions 404, 406 may be structured such that a total of all of the spaced-apart portions 404, 406 in a length direction L summed together is equal to or within about 5% to 10% of a length of the housing 210 in the length direction L.

FIGS. 5A, 5B, and 9D depict an embodiment of the present technology in which the shell 400 includes two symmetrically arranged spaced-apart portions 406 on a front longer side 412*a* of the shell 400, which is proximate the front longer segment 222*a* of the wall 220, and also includes one centrally arranged spaced-apart portion 404 on a rear longer side 412*b* of the shell 400, which is proximate the rear longer segment 222*b* of the wall 220. It should be understood, however, that in various other embodiments there may two or more spaced-apart portions on each of the front and rear longer sides 412*a*, 412*b* of the shell 400, and these spaced-apart portions need not be symmetrically arranged. Optionally, the shell 400 may include one or more spaced apart portion on one or both of left and right shorter sides 408*a*, 408*b* of the shell 400, and/or one non-centrally arranged spaced-apart portion on one or both of the longer sides 412*a*, 412*b* of the shell 400.

According to some embodiments of the present technology, depicted in FIG. 9D, the shell 400 has four corners: a front left corner 414*a*, a rear left corner 414*b*, a front right corner 416*a*, and a rear right corner 416*b*. The front and rear left corners 414*a*, 414*b* are located at opposite ends of the left shorter side 408*a* of the shell 400. The front and rear right corners 416*a*, 416*b* are located at opposite ends of the right shorter side 408*b* of the shell 400. The front corners 414*a*, 416*a* are located at opposite ends of the front longer side 412*a* of the shell 400, and the rear corners 414*b*, 416*b* are located at opposite ends of the rear longer side 412*b* of the shell 400.

The rear left corner 414*b* of the shell 400 conforms with and abuts a rear left corner 226*b* of the wall 220 of the housing 210, and rear right corner 416*b* of the shell 400 conforms with and abuts a rear right corner 228*b* of the wall 220 of the housing 210.

The front left corner 414*a* of the shell 400 does not conform with or abut a front left corner 226*a* of the wall 220 of the housing 210. Instead, the front left corner 414*a* of the shell 400 and the front left corner 226*a* of the wall 220 define corners of a left one of the spaces 420 bounded by a left one of the spaced-apart portions 406, as shown in FIG. 5A. Similarly, the front right corner 416*a* of the shell 400 does not conform with or abut a front right corner 228*a* of the wall 220 of the housing 210, but instead define corners of a right one of the spaces 420 bounded by a right one of the spaced-apart portions 406, as shown in FIG. 5A. Thus, each of the left and right shorter sides 408*a*, 408*b* of the shell 400 includes part of the conforming portions 402 and also part of the spaced-apart portions 406 of the shell 400.

Projection tabs 470*a*, 470*b*, 470*c* may extend from a lower edge of the shell 400, as shown in FIGS. 2A, 2B, 4A, and 4B. For example, the projection tabs 470*a* may extend from the lower edge of the left shorter side 408*a* of the shell 400, the projection tabs 470*b* may extend from the lower edge of the right shorter side 408*b* of the shell 400, and the projection tabs 470*c* may extend from the lower edge of the spaced-apart portion 404 of the shell 400. The projection tabs 470*a*, 470*b*, 470*c* may extend in an axial direction of the connector 1 (i.e., the direction X) and may be configured to connect with or be attached to a PCB board (not shown) on which the connector 1 is to be mounted. The projection tabs 470*a* on the left shorter side 408*a* of the shell 400 may be spaced asymmetrically with respect to the projection tabs 470*b* on the right shorter side 408*b* of the shell 400. Such asymmetry may ensure that the connector 1 is oriented properly in corresponding holes in the PCB prior to attachment (e.g., soldering). After the connector 1 is attached to the PCB, the projection tabs 470*a*, 470*b*, 470*c* may provide mechanical support for the connector 1. In some embodiments, at least one of the projection tabs 470*a*, 470*b*, 470*c* extends from the lower edge of each of the spaced-apart portions 404, 406.

An orientation of the connector 1 may be easily determined by a user via the shell 400, which may be structured to have front and rear sides that are different from each other. For example, the centrally positioned spaced-apart portion 404 on the rear longer side 412*b* of the shell 400 may have a height $H_3$ that is greater than a height $H_2$ of the spaced-apart portions 406 on the front longer side 412*a* of the shell 400, as shown in FIGS. 6 and 3A. The height $H_2$ of the spaced-apart portions 406 on the front longer side 412*a* of the shell 400 and a region of the shell 400 between these portions 406 may be the same, and also may be the same as a maximum height of the housing 210 (i.e., $H_2$ may be the maximum height of the housing 210). This enables a user to see that the shell 400 and the housing 210 are properly engaged with each other, whether before attachment to a printed circuit board or after.

The corners 414*a*, 414*b*, 416*a*, 416*b* of the shell 400 may have a height that is greater than the height $H_3$ of the spaced-apart portion 404 on the rear longer side 412*b* of the shell 400. In some embodiments of the present technology, such as shown in FIGS. 3A, 4A, and 4B, the corners 414*a*, 414*b*, 416*a*, 416*b* may all have the same height $H_1$, which may be the maximum height of the connector 1. In other embodiments, the corners 414*a*, 414*b*, 416*a*, 416*b* may have more than one height, and these heights may be greater than a maximum height of the housing 210. For example, the rear corners 414*b*, 416*b* may have a first height, the front corners 414*a*, 416*a* may have a second height different from the first height, and each of the first and second heights may be greater than the maximum height of the housing 210.

The front longer side 412*a* of the shell may have front guide portions 452*a* that connect the front corners 414*a*, 416*a* of the shell 400 to a part of the spaced-apart portions 406 of the shell 400 having a lower height. The rear longer side 412*b* of the shell 400 may have rear guide portions 452*b* that connect the rear corners 414*b*, 416*b* of the shell 400 to the spaced-apart portion 404 of the shell 400. As shown in FIG. 3A, the front guide portions 452*a* have a height that changes from $H_1$ to $H_2$, and the rear guide portions 452*b* have a height that changes from $H_1$ to $H_3$. Upper edges of the guide portions 452*a*, 452*b* may be sloped or vertical, and may be curved or straight. For example, the front guide portions 452*a* may be substantially vertical, and the rear guide portions 452*b* may have a straight slope, as shown in FIG. 3A.

As can be seen in FIGS. 1A, 1C, 2A, and 2B, the left shorter side 408*a* of the shell 400 and left ones of the front and rear guide portions 452*a*, 452*b* adjacent the left shorter side 408*a* of the shell 400 have portions that extend above the housing 210 to form a three-sided protruding structure on the left side of the connector 1. Similarly, the right shorter side 408*b* of the shell 400 and right ones of the front and rear guide portions 452*a*, 452*b* adjacent the right shorter side 408*b* of the shell 400 have portions that extend above the housing 210 to form a three-sided protruding structure on the right side of the connector 1. These three-sided protruding structures may flank and constrain the plug connector 2 when the plug connector is in the mated position relative to the connector 1, which may prevent the plug connector 2 from undergoing twisting relative to the connector 1 due to internal and/or external forces and consequently may prevent inadvertent disconnection of the mated connectors 1, 2.

In addition to facilitating alignment of the plug connector 2 with the connector 1 during a mating process and constraining movement of the plug connector 2 relative to the connector 1, the upper edges of the guide portions 452*a*, 452*b* may enable a user to recognize, for example, an orientation of the connector 1, e.g., a front side and a rear side.

An upper edge of the left shorter side 408*a* of the shell 400 may have a straight (horizontal) profile or a non-linear profile. Similarly, an upper edge of the right shorter side 408*b* of the shell 400 may have a straight profile or a non-linear profile. In some embodiments of the present technology, the non-linear profiles may be curved, as shown in FIGS. 6, 4A, and 4B. A minimum height of the left and right shorter sides 408*a*, 408*b* of the shell 400 may be less than the maximum height the connector $H_1$ and greater than the maximum height of the housing $H_2$. In the embodiment shown in FIG. 3A, the minimum height of the left and right shorter sides 408*a*, 408*b* of the shell 400 is less than the maximum height of the connector $H_1$ and greater than the height of the spaced-apart portion 404 $H_3$.

In some embodiments of the present technology, the shell 400 may be retained on the housing 210 with projections, e.g., shaped as hooks 450, such as shown in FIGS. 6 and 9A-9D. The hooks 450 may be configured to engage with the wall 220 of the housing 210 to secure the shell 400 to the housing 210 at a predetermined position relative to each other. In some embodiments of the present technology, the hooks 450 may be structured to engage with notched portions 226 on the upper edge of the wall 220 such that, in an engaged position, an external surface of each of the hooks does not protrude beyond the upper edge of the wall 220, as depicted in FIG. 3A. For example, the external surface of each of the hooks 450 may be structured to align with the upper edge of the wall 220 on the longer front segment 222*a* of the wall 220.

When the shell 400 and the wall 220 are in the engaged position such that they are at the predetermined position relative to each other, a mating process for mating the plug connector 2 with the connector 1 may be performed predictably and reproducibly to achieve the mated position. The hooks 450 and the notched portions 226 may be structured to help a user confirm that the shell 400 and the housing 210 are oriented properly relative to each other during assembly of the connector 1.

As shown in FIGS. 3A, 3B, 7, 8A, and 8B, the wall 220 of the housing 210 may include recessed portions 250*a*, 250*b* configured to receive latching portions 454*a*, 454*b* of the shell 400. The latching portions 454*a*, 454*b* may prevent the shell 400 from sliding off the housing 210 when the connector 1 is in an assembled state. For example, the recessed portions 250*a* may be disposed on the front longer segment 222*a* of the wall 220, and the recessed portions 250*b* may be disposed on the rear longer segment 222*b* of the wall 220. The latching portions 454*a* may be disposed on the front longer side 412*a* of the shell 400, and the latching portions 454*b* may be disposed on the rear longer side 412*b* of the shell 400. When the shell 400 and the housing 210 are assembled together, the latching portions 454*a*. 454*b* may latch with the recessed portions 250*a*, 250*b* to make snap-fit connections and prevent movement of the shell 400 relative to the housing 210. The recessed portions 250*a*, 250*b* may be formed partially or completely through a thickness of the wall 220. The shell 400 may be formed of metal, and the latching portions 454*a*, 454*b* may be portions of the shell 400 that are cut and bent to form springy tabs or latches that engage with the recessed portions 250*a*, 250*b*.

The shell 400 also may include lock holes 460 that are structured to engage with barbs 260 on the wall 220 of the housing 210 such that, when the shell 400 and the housing 210 are assembled together, the lock holes 460 and the barbs 260 prevent slipping movement of the shell 400 relative to the housing 210. For example, the shell 400 may be sufficiently resilient such that during assembly the shell 400 may flex slightly to enable to barbs 260 to snap into the lock holes 460. Each of the barbs 260 may be structured with an angled surface on one side and a ledge surface on an opposite side, which may enable the barbs 260 to snap in place easily via the angled surface during assembly, and to lock in place via the ledge surface after assembly, so that the shell 400 and the housing 210 may not be easily separated from each other.

Figure 11:
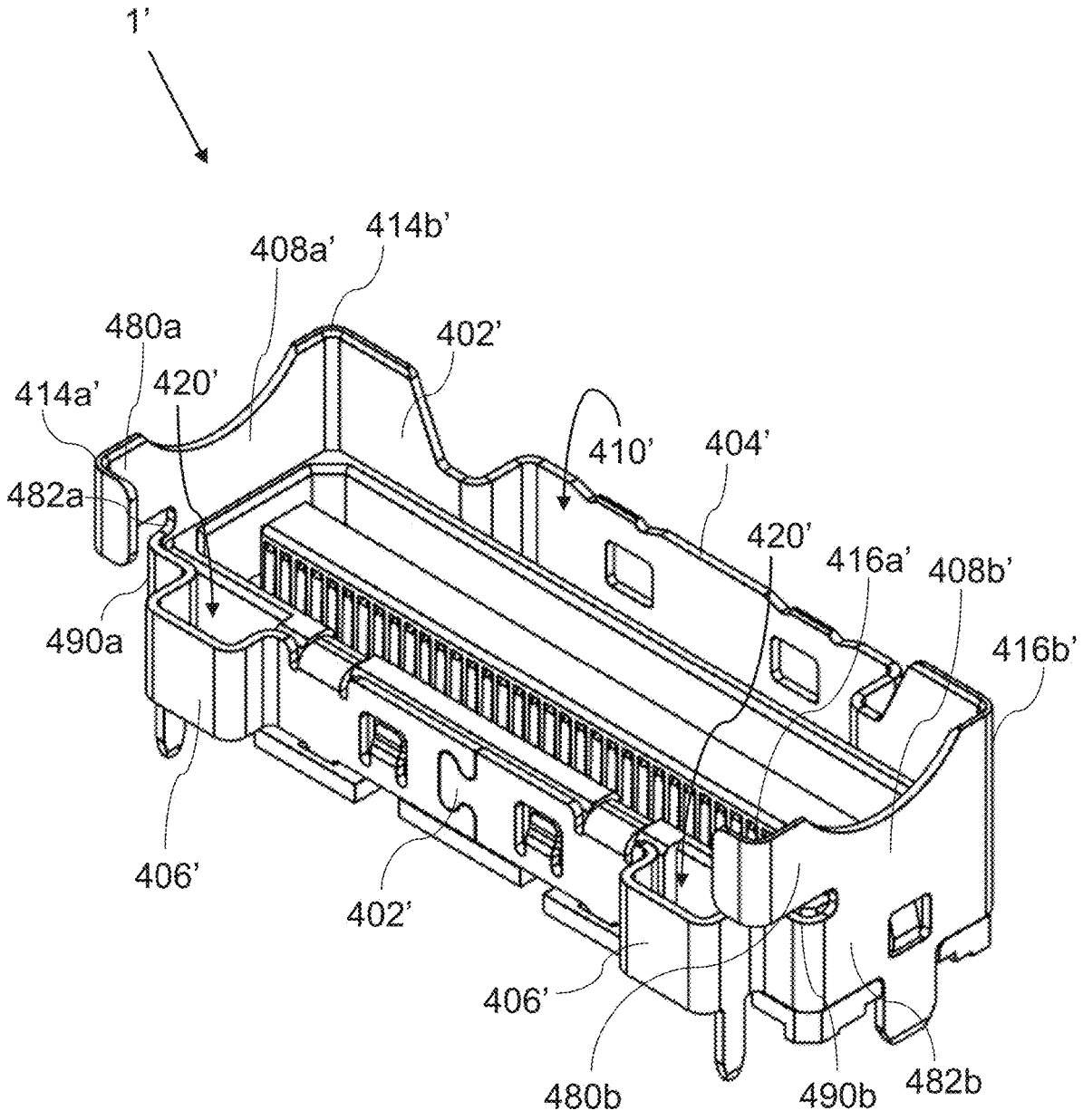
FIG. 11 is a top front perspective view of an electrical connector, according to some embodiments of the present technology.

FIG. 11 shows an example of an electrical connector 1' according to some embodiments of the present technology. The connector 1' may be a receptacle connector configured to mate with the plug connector 2 of FIG. 1B to form a mated pair. The connector 1' may include the housing assembly 200 (see FIG. 7) and a shell 400'. That is, the connector 1' may differ from the connector 1 only in the shell 400'. Therefore, to avoid redundancy, the following description of the connector 1' will focus on the shell 400' without repeating the discussion of the housing assembly 200.

The shell 400' of the connector 1' may be configured to encircle an outer surface 210*a* of the housing 210. In some embodiments of the present technology, the shell 400' may be stamped from a sheet of metal that is formed into the shape illustrated in the drawings. Ends of that strip of metal may be joined, such as by welding or brazing or via a mechanical attachment. In some embodiments, the shell 400' may fully encircle the housing 210, with portions of the shell 400' adjacent some sections of the wall 220 of the housing 210 and with portions of the shell spaced apart from some section of the wall 220, so as to encircle only partially the housing 210.

The shell 400' may include one or more conforming portions 402', each of which conforms with and is adjacent the outer surface 210*a* of the housing 210. The shell 400' also may include one or more spaced-apart portions 404', 406', each of which may be separated or spaced apart from the outer surface 210*a* of the housing 210 to define a space 410', 420' therebetween. In some embodiments, at least some of the conforming portions 402' of the shell 400' have a snug fit with the housing 210 when the housing 210 and the shell 400' are assembled together.

In some embodiments of the present technology, the shell 400' may have a spaced-apart portion 404' on one side (e.g., a rear side) and at least one spaced-apart portion 406' on an opposite side (e.g., a front side). similar to the shell 400. The spaced-apart portions 404', 406' may be arranged such that no spaced apart portion on one side of the shell 400' is directly opposite another spaced apart portion on the opposite side of the shell. Additionally, in some embodiments, no part of the spaced-apart portion 404' on the rear side of the shell 400' is directly opposite any part of the spaced-apart portions 406' on the front side. Such a structure may facilitate a "blind" mating operation, where a user may not be able to see one or both of the connectors 1', 2 when mating the connectors 1', 2 together, by letting the user know that there is a misalignment before the user uses any force to push the connectors 1', 2 together.

According to some embodiments of the present technology, the shell 400' may have six corners: a front left corner 414*a*', a rear left corner 414*b*', a front right corner 416*a*', a rear right corner 416*b*', and two additional corners, discussed below. The front and rear left corners 414*a*', 414*b*' are located at opposite ends of the left shorter side 408*a*' of the shell 400'. The front and rear right corners 416*a*', 416*b*' are located at opposite ends of the right shorter side 408*b*' of the shell 400'. The rear corners 414*b*', 416*b*' are located at opposite ends of the rear longer side 412*b*' of the shell 400'. The rear left corner 414*b*' of the shell 400' conforms with and abuts a rear left corner 226*b* of the wall 220 of the housing 210, and rear right corner 416*b*' of the shell 400' conforms with and abuts a rear right corner 228*b* of the wall 220 of the housing 210.

In some embodiments of the present technology, the left shorter side 408*a*' of the shell 400' may be comprised of an upper portion 480*a* and a lower portion 482*a*. The front left corner 414*a*' of the shell 400' may be located at an end of the upper portion 480*a* of the left shorter side 408*a*' of the shell 400'. A left conforming corner 490*a* of the shell 400' may be located at an end of the lower portion 482*a* of the left shorter side 408*a*' of the shell 400' and may conform with the front left corner 226*a* of the wall 220 of the housing 210. Similarly, the right shorter side 408*b*' of the shell 400' may be comprised of an upper portion 480*b* and a lower portion 482*b*. The front right corner 416*a*' of the shell 400' may be located at an end of the upper portion 480*b* of the right shorter side 408*b*' of the shell 400'. A right conforming corner 490*b* of the shell 400' may be located at an end of the lower portion 482*b* of the right shorter side 408*b*' of the shell 400' and may conform with the front right corner 228*a* of the wall 220 of the housing 210. The spaces 420' may not include the left and right corners 226*a*, 228*a* of the wall 220 but may be at a distance from the corners 226*a*, 228*a* of the housing 210. Thus, the left shorter side 408*a'* of the shell 400' may be comprised of a cantilevered portion that includes the front left corner 414*a'* of the shell 400', and the right shorter side 408*b'* of the shell 400' may be comprised of a cantilevered portion that includes the front right corner 416*a'* of the shell 400'. The cantilevered portions of the shell 400' may serve to guide an initial alignment of the plug connector 2 with the connector 1' during a mating operation. For example, the cantilevered portions of the shell 400' may enable a user to generally or roughly locate a region near the spaces 420' in which the legs 10 of the plug connector 2 are to be inserted by locating the cantilevered portions and then using the corners 414*a'*, 416*a'* of the cantilevered portions as references for a more precise alignment of the legs 10.

Figure 10A:
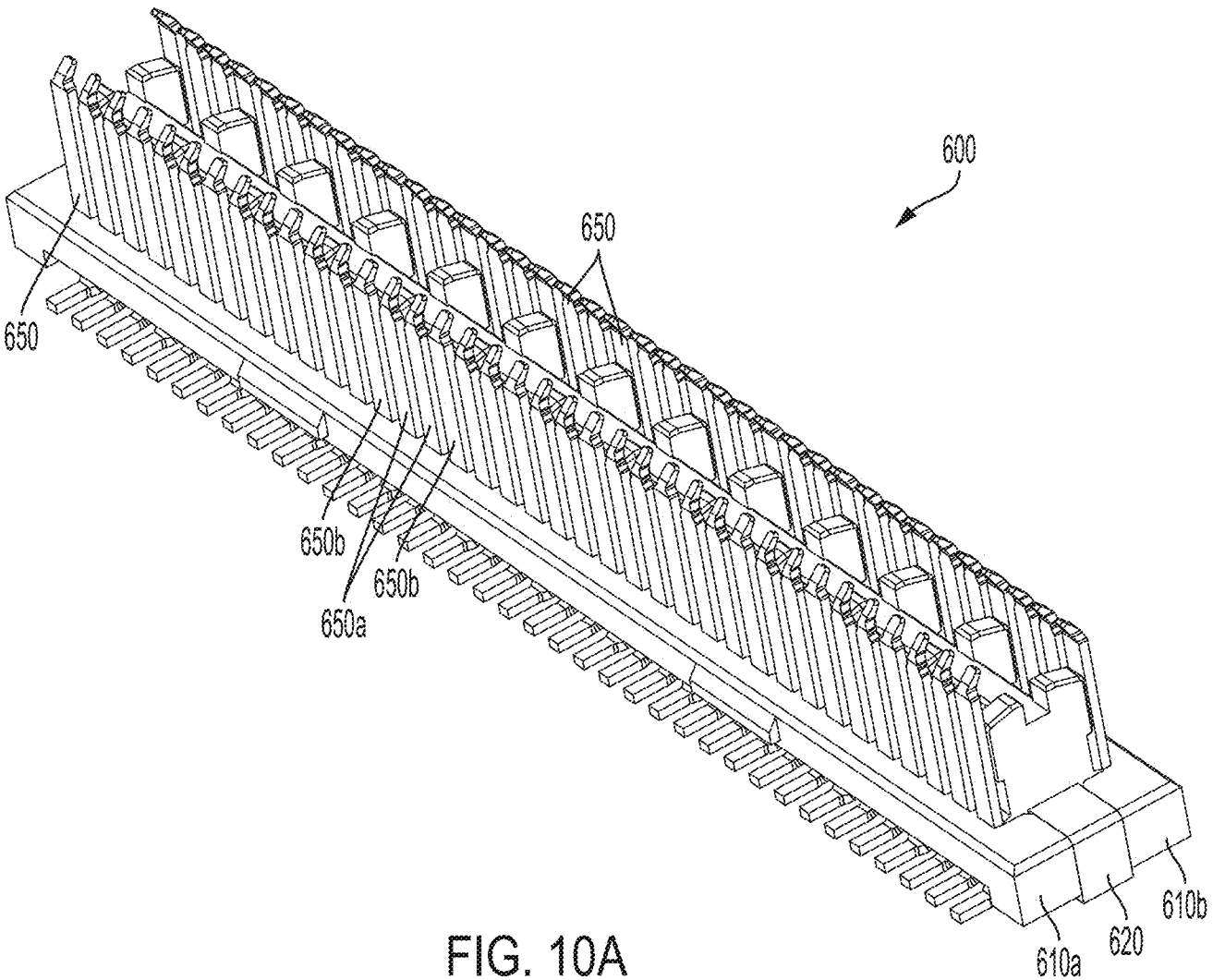
FIG. 10A shows a perspective view of a terminal assembly of the housing assembly of FIG. 7, according to some embodiments of the present technology.
Figure 10B:
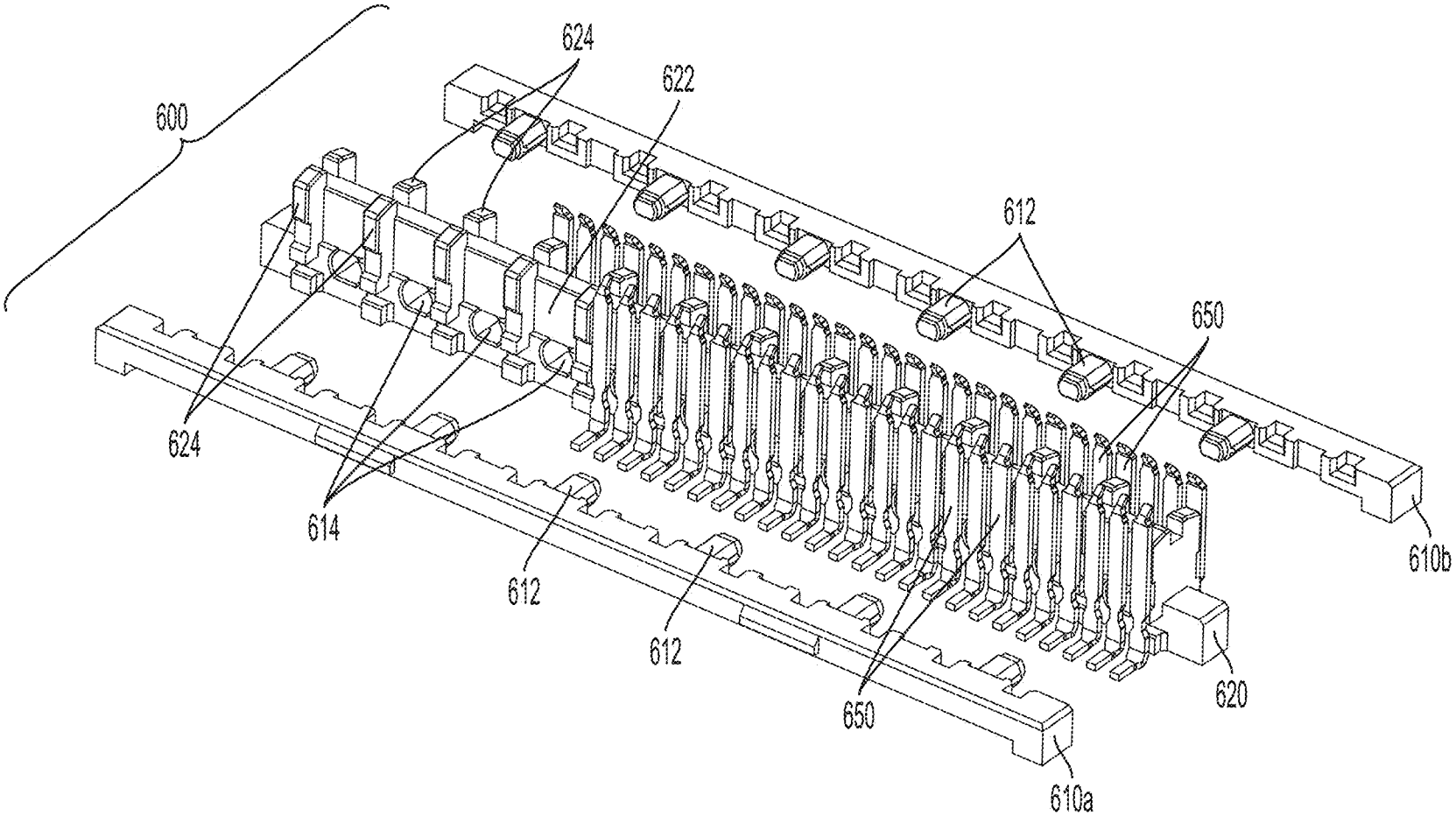
FIG. 10B is a perspective view of the terminal assembly of FIG. 10A, in a partially disassembled state, with some features hidden for improved clarity of other features.
Figure 10D:
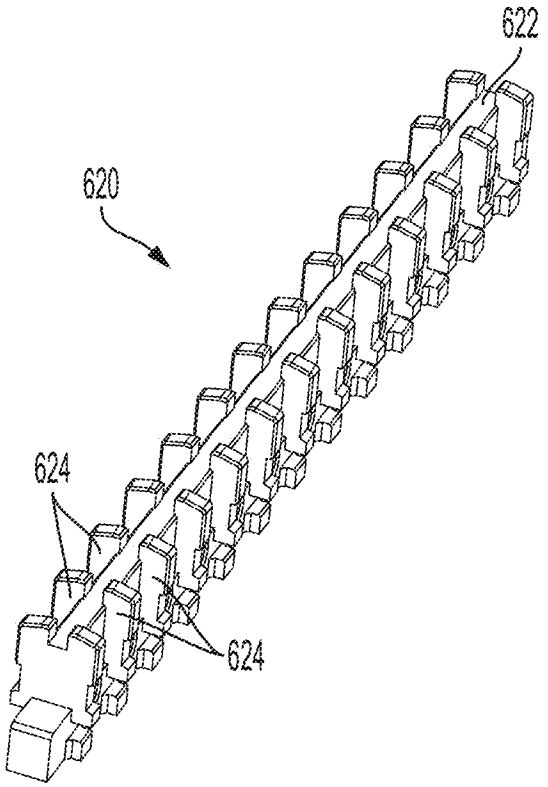
FIGS. 10C and 10D are perspective views of terminals and a central bar, respectively, of the terminal assembly of FIG. 10A, according to some embodiments of the present technology.
Figure 10C:
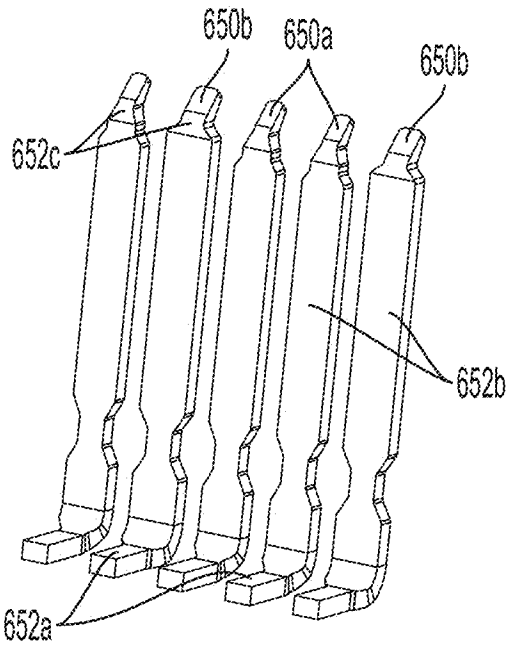

FIG. 10A shows a perspective view of the terminal assembly 600 of the housing assembly 200. The terminals 650 of the terminal assembly may include signal terminals 650*a* and ground terminals 650*b*, as depicted in FIG. 10C. FIG. 10B depicts a disassembled view of the terminal assembly 600, with some of the terminals 650 hidden to reveal various structural aspects of the terminal assembly 600.

The terminal assembly 600 may include first and second terminal bars 610*a*, 610*b* and a central bar 620 that may be sandwiched between the first and second terminal bars 610*a*, 610*b* when the terminal assembly 600 is in an assembled state. Each terminal 650, (i.e., 650*a*, 650*b*) may have a mounting portion 652*a*, an intermediate portion 652*b*, and a tail 652*c*. The central bar 620 may be formed of an electrically lossy material.

Materials that conduct, but with some loss, or material which by another physical mechanism absorbs electromagnetic energy over the frequency range of interest are referred to herein generally as "lossy" materials. Electrically lossy materials can be formed from lossy dielectric and/or poorly conductive and/or lossy magnetic materials. Magnetically lossy material can be formed, for example, from materials traditionally regarded as ferromagnetic materials, such as those that have a magnetic loss tangent greater than approximately 0.05 in the frequency range of interest. The "magnetic loss tangent" is the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest.

Electrically lossy material can be formed from material traditionally regarded as dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor such as copper over the frequency range of interest.

Electrically lossy materials typically have a bulk conductivity of about 1 Siemen/meter to about 10,000 Siemens/meter and preferably about 1 Siemen/meter to about 5,000 Siemens/meter. In some embodiments of the present technology, material with a bulk conductivity of between about 10 Siemens/meter and about 200 Siemens/meter may be used. As a specific example, material with a conductivity of about 50 Siemens/meter may be used. However, it should be appreciated that the conductivity of the material may be selected empirically or through electrical simulation using known simulation tools to determine a suitable conductivity that provides a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material has a surface resistivity between 10 Ω/square and 1000 Ω/square. As a specific example, the material may have a surface resistivity of between about 20 Ω/square and 80 Ω/square.

In some embodiments of the present technology, electrically lossy material is formed by adding to a binder a filler that contains conductive particles. In such an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used.

Also, while the above-described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when fiber is used, the fiber may be present in about 3% to 50% by volume, such as in a range of 30-40%. The amount of filler may impact the conducting properties of the material.

Filled materials may be purchased commercially, such as materials sold under the trade name Celestran® by Celanese Corporation which can be filled with carbon fibers or stainless-steel filaments.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a lossy portion may be manufactured by stamping a preform or sheet of lossy material. Alternatively, a lossy insert may be separately molded and inserted into a connector.

Lossy portions also may be formed in other ways. In some embodiments, a lossy portion may be formed by interleaving layers of lossy and conductive material such as metal foil. These layers may be rigidly attached to one another, such as through the use of epoxy or other adhesive, or may be held together in any other suitable way. The layers may be of the desired shape before being secured to one another or may be stamped or otherwise shaped after they are held together. As a further alternative, lossy portions may be formed by plating plastic or other insulative material with a lossy coating, such as a diffuse metal coating.

As another example, a lossy portion may be formed by attaching a metal skeleton to conductors, such as ground conductors, within a connector. Such connections may be formed by welding, for example. A lossy portion may thereafter be attached to the metal skeleton.

Referring to FIG. 10C, the mounting portion 652*a*, which may be hooked relative to the intermediate portion 652*b*, may configured to be mounted to a PCB by, for example, a SMT solder-mounting technique or another bonding technique. The tail 652*c* may be hooked relative to the intermediate portion 652*b*. In FIG. 10C, the tails 652*c* are shown to be hooked in a first direction relative to the intermediate portions 652*b*, and the mounting portions 652*a* are shown to be hooked in a second direction generally opposite to the first direction. It should be appreciated that the configurations shown in FIG. 10C are merely examples, and the terminals 650*a*, 650*b* may have other configurations than those shown.

The mounting portion 652*a* may be considered a fixed end of the terminal 650, because the mounting portion 652*a* is intended to be fixed to, e.g., a PCB (not shown). In contrast, the tail 652*c* may be considered a distal free end of the terminal 650, because the tail 652*c* is not constrained but instead may move in response to a force applied to various portions of the terminal 650, including a force applied by the plug connector 2 when mated to the connector 1 in which the terminal 650 is disposed. For example, the mounting portions 652*a* may extend through the first and second terminal bars 610*a*, 610*b*, such that the mounting portions 652*a* may be externally exposed on the housing assembly 200 to enable connections (e.g., solder connections) to be made to the mounting portions 652*a*, as depicted in FIG. 1D.

The terminals 650 may be arranged in two parallel rows sandwiching the central bar 620 in between. The mounting portions 652*a* of the terminals 650 may be configured to hook away from the central bar 620. The terminals 650 may be molded in place in the first and second terminal bars 610*a*, 610*b* to form the two parallel rows. Alternatively, the first and second terminal bars 610*a*, 610*b* may be positioned respectively against the terminals 650 to hold the terminals 650 in place in the two parallel rows.

The central bar 620 may include a support portion 622, which may extend along a length of the central bar 620, and projections 624 that extend laterally from the central bar 620 and that are structured to come into contact with the ground terminals 650*b*. For example, each of the ground terminals 650*b* in the two parallel rows on the first and second terminal bars 610*a*, 610*b* may be separated from another of the ground terminals 650*b* in the same row by a pair of signal terminals 650*a*; the projections 624 may be structured to contact the intermediate portions 652*b* of the ground terminals 650*b*, but may not connect the signal terminals 650*a*.

The intermediate portions 652*b* and the tails 652*c* may extend into an interior cavity of the island 240 such that a segment of each of the terminals 650 may be exposed through the channels or slots 244 in the island 240 and may make contact with corresponding terminals in the plug connector 2.

Each of the first and second terminal bars 610*a*, 610*b* may include projections 612 structured to be received in openings 614 in the central bar 620. For example, the projections 612 of the first terminal bar 610*a* may be staggered relative to the projections 612 of the second terminal bar 610*b*, such that two adjacent openings 614 may receive one projection 612 from the first terminal bar 610*a* and one projection 612 from the second terminal bar 610*b*. When the terminal assembly 600 is in an assembled state, the projections 612 in the openings 614 may act to prevent displacement or shifting of the terminals 650.

As described herein, in some embodiments of the present technology, the plug connector 2 may have features that, during mating of the plug and receptacle connectors, fit within the spaces 410, 420 defined by the spaced-apart portions 404, 406 of the shell 400. These features may extend past the mating portion 4 of the plug connector 2, along the direction Y (see FIG. 1B), such that they fit within the spaces 410, 420 before the connectors 1, 2 are mated. Engagement of these features may align the direction Y relative to the plug connector 2 with the direction X (see FIG. 1A) relative to the connector 1, which may guide a user, in applying a force to urge the plug connector 2 towards the connector 1, to apply a force perpendicular to a substrate (e.g., a PCB) to which the connector 1 is mounted, thereby reducing the risk of damage during mating that can interfere with the integrity of signals passed through the mated connectors 1, 2.

More specifically, the spaces 410, 420 defined by the spaced-apart portions 404, 406 of the shell 400 may be structured to receive protrusions of the plug connector 2. For example, the spaces 420 may be configured to receive legs 10 of the plug connector 2 therein; and the space 410 may be configured to receive a bar-shaped member 8 of the plug connector 2 therein. The spaced apart portions 404, 406 enable a user to align the plug connector 2 properly with the connector 1 before using force to mate the two connectors 1, 2 together. That is, the user may use the spaced apart portions 404, 406 of the connector 1 and the legs 10 and the bar-shaped member 8 of the plug connector 2 to achieve a general alignment during an initial part of a mating operation. Once alignment is achieved, the user may be confident that force used to push the two connectors 1, 2 together into a final mated position will not damage either of the two connectors 1, 2. As noted above, FIG. 1B shows a plug connector generally of the type that may be mated with a connector generally of the type shown in FIG. 1A, although some dimensions of the plug connector 2 would need to be modified to have an exact or closer-to-exact fit with the connector 1. More specifically, for example, the legs 10 of the plug connector 2 would need to be modified to be located at outer corners of a long side of the plug connector 2 instead of what is depicted in FIG. 1B (i.e., instead of the legs 10 being slightly inset from the outer corners on the long side, as shown) to have an exact or closer-to-exact fit. Nevertheless, a full understanding of how the connector 1 and a plug connector of the type generally shown in FIG. 1B would properly mate may still be obtained from FIGS. 1A, 1B and the descriptions herein.

As noted above, the conforming portions 402 of the shell 400 may include a part of each of the left and right shorter sides 408*a*, 408*b* of the shell 400. In some embodiments of the present technology, some or all of the left and right shorter segments 224*a*, 224*b* of the wall 220 conform with or abut the left and right shorter sides 408*a*, 408*b* of the shell 400. Also as noted above, portions of the left and right shorter sides 408*a*, 408*b* of the shell 400 and may define the spaced-apart portions 406 of the shell 400. The conforming portions 402 may be disposed along one or both of the front and rear longer segments 222*a*, 222*b* of the wall 220. Optionally, the shell 400 may include one or more spaced-apart portion(s) (not shown) disposed along one or both of the left and right shorter segments 224*a*, 224*b* of the wall 220.

Various embodiments of the connector 1 disclosed herein include guide portions 452*a*, 452*b* at four corners of the shell 400. As can be seen in, e.g., FIG. 1A, a portion of shell 400 has an upper edge aligned with an upper edge of the wall 220, whereas the guide portions 452*a*, 452*b* extend or protrude above the upper edge of wall 220. The guide portions 452*a*, 452*b* together with the left and right shorter sides 408*a*, 408*b* of the shell 400 aid a user to align the plug connector 2 properly with respect to the connector 1. For example, the user may move the plug connector 2 towards the guide portions 452*a*, 452*b* and, when the plug connector 2 engages with the guide portions 452*a*, 452*b*, the plug connector 2 may be aligned such that the legs 10 and the bar-shaped member 8 are aligned with respect to the spaced-apart portions 406, 404 of the connector 1. In this way, the user may be guided so as not to apply a downward force until the connectors 1, 2 are in a position that the downward force is unlikely to damage either of the connectors 1, 2. Further, as noted above, the guide portions 452*a*, 452*b* together with the left and right shorter sides 408*a*, 408*b* of the shell 400 form a pair of three-sided protruding structures that may prevent the plug connector 2 from twisting relative to the connector 1, thus minimizing the risk of inadvertent disconnection of the plug connector 2 from the connector 1.

An electrical connector according to the technology described herein may be embodied in different configurations. Example configurations include combinations of configurations (1) through (21), as follows:

(1) An electrical connector comprising: a housing comprising a bottom and a wall bounding, at least in part, an opening adjacent the bottom; an island protruding from the bottom of the housing and into the opening; a plurality of terminals supported by the island; and a shell configured to encircle an outer surface of the wall, wherein the shell includes: a pair of first shell corners configured to conform with a pair of first housing corners of the housing, a height of the first shell corners being greater than a maximum height of the housing, a pair of second shell corners configured to be spaced apart from a pair of second housing corners of the housing in a first direction, a height of the second shell corners being greater than the maximum height of the housing, a plurality of first portions configured to conform with the outer surface of the wall, a plurality of second portions configured to be spaced apart from the outer surface of the wall, and a plurality of hook portions configured to engage with an edge of the wall.

(2) The electrical connector of configuration (1), wherein: the wall of the housing has first and second longer sections connected to first and second shorter sections, at least one of the first portions of the shell and at least one of the second portions of the shell are located along the first longer section of the wall; and at least one of the first portions of the shell and at least one of the second portions of the shell are located along the second longer section of the wall.

(3) The electrical connector of any of configurations (1) through (2), wherein a number of the at least one of the first portions of the shell located along the first longer section of the wall is different from a number of the at least one of the second portions of the shell located along the first longer section of the wall.

(4) The electrical connector of any of configurations (1) through (3), wherein a number of the at least one of the first portions of the shell located along the second longer section of the wall is different from a number of the at least one of the second portions of the shell located along the second longer section of the wall.

(5) The electrical connector of any of configurations (1) through (4), wherein a height of a portion of the shell on which the hook portions are located is approximately equal to the maximum height of the housing.

(6) The electrical connector of any of configurations (1) through (5), wherein each of the first and second shell corners have a same height.

(7) The electrical connector of any of configurations (1) through (6), wherein: each of the first shell corners has a first height, and each of the second shell corners has a second height different from the first height.

(8) The electrical connector of any of configurations (1) through (7), wherein the wall of the housing has first and second longer sections connected to first and second shorter sections, and the pair of first housing corners are adjacent the first longer section of the wall.

(9) The electrical connector of any of configurations (1) through (8), wherein the shell includes a first section that joins a first of the first shell corners to a first of the second shell corners, the shell includes a second section that joins a second of the first shell corners to a second of the second shell corners, the first section of the shell includes a portion that conforms with the first shorter section of the wall, and the second section of the shell includes a portion that conforms with the second shorter section of the wall.

(10) The electrical connector of any of configurations (1) through (9), wherein the first section of the shell includes a portion that faces a first space corresponding to one of the second portions of the shell, and the second section of the shell includes a portion that faces a second space corresponding to another one of the second portions of the shell.

(11) The electrical connector of any of configurations (1) through (10), wherein a boundary of the first space includes a first one of the pair of second shell corners, and a boundary of the second space includes a second one of the pair of second shell corners.

(12) The electrical connector of any of configurations (1) through (11), wherein each of the first and second sections of the shell includes an upper edge having a curved portion, and a height of the shell at the curved portions is greater than the maximum height of the housing and less than the height of each of the first and second shell corners.

(13) The electrical connector of any of configurations (1) through (12), wherein the shell includes a third section that joins the pair of first shell corners, the shell includes a fourth section that joins the pair of second shell corners, and a height of the third section is greater than the maximum height of the housing.

(14) The electrical connector of any of configurations (1) through (13), wherein the first portions of the shell include a conforming portion that is part of the fourth section of the shell, and a height of the conforming portion of the fourth section of the shell is same as or within 10% of a height of a portion of the wall directly facing the conforming portion.

(15) The electrical connector of any of configurations (1) through (14), wherein the hook portions extend from an upper edge of the conforming portion of the fourth section of the shell.

(16) The electrical connector of any of configurations (1) through (15), wherein the outer surface of the wall and the second portions of the shell delimit a plurality of spaces configured to receive a plurality of plug portions of a plug connector therein when the plug connector is in a mating position with the electrical connector.

(17) The electrical connector of any of configurations (1) through (16), wherein the spaces delimited by the second portions of the shell are arranged such that the electrical connector has a single mating position with the plug connector.

(18) The electrical connector of any of configurations (1) through (17), wherein the wall includes first and second longer sections separated from each other by first and second shorter sections to form a substantially rectangular outer boundary, and the spaces delimited by the second portions of the shell include a first space located along the first longer section of the wall, the first space having a length greater than about half a length of the first longer section in a second direction, and a plurality of second spaces located along the second longer section of the wall, each of the second spaces having a length less than about a quarter of a length of the second longer section in the second direction.

(19) The electrical connector of any of configurations (1) through (18), wherein the first space is configured to receive a bar-shaped portion of the plug connector, and each of the second spaces is configured to receive a leg of the plug connector.

(20) The electrical connector of any of configurations (1) through (19), wherein the shell includes a plurality of legs extending in away from the housing and configured to engage with a printed circuit board (PCB).

(21) The electrical connector of any of configurations (1) through (20), wherein the edge of the wall includes a plurality of notches configured to engage with the hook portions of the shell.

An electrical connector according to the technology described herein may be embodied in different configurations. Example configurations include combinations of configurations (22) through (37), as follows:

(22) An electrical connector comprising: an insulative housing comprised of a bottom and a wall extending from the bottom at a periphery of the bottom; and a shell configured to encircle an outer surface of the wall, wherein the shell includes: a pair of first shell corners configured to conform with a pair of first housing corners of the housing, a height of the first shell corners being greater than a maximum height of the housing, a pair of second shell corners configured to be spaced apart from a pair of second housing corners of the housing in a first direction, a height of the second shell corners being greater than the maximum height of the housing, a plurality of first portions configured to conform with the outer surface of the wall, a plurality of second portions configured to be spaced apart from the outer surface of the wall, and a plurality of hook portions configured to engage with an edge of the wall.

(23) The electrical connector of configuration (22), wherein each of the second portions of the shell bounds a space between the outer surface of the wall and the shell, and each of the spaces is configured to receive a portion of a mating connector therein.

(24) The electrical connector of any of configurations (22) through (23), wherein the wall is comprised of first and second longer wall portions and first and second shorter wall portions, at least one of the spaces is located along each of the first and second longer wall portions, a first section of the shell conforms with the outer surface of the wall at the first shorter wall portion, and a minimum height of the first section is greater than a maximum height of the housing, and a second section of the shell conforms with the outer surface of the wall at the second shorter wall portion, and a minimum height of the second section is greater than the maximum height of the housing.

(25) The electrical connector of any of configurations (22) through (24), wherein a number of the second portions of the shell located along the first longer wall portion is different from a number of the second portions of the shell located along the second longer wall portion.

(26) The electrical connector of any of configurations (22) through (25), wherein the spaces are arranged such that the electrical connector has a single mating position with the mating connector.

(27) The electrical connector of any of configurations (22) through (26), wherein the spaces include a first space located along the first longer wall portion, the first space having a length greater than about half a length of the first longer wall portion in a second direction, and a plurality of second spaces located along the second longer wall portion, each of the second spaces having a length less than about a quarter of a length of the second longer wall portion in the second direction.

(28) The electrical connector of any of configurations (22) through (27), wherein a height of a portion of the shell on which the hook portions are located is approximately equal to the maximum height of the housing.

(29) The electrical connector of any of configurations (22) through (28), wherein each of the first and second shell corners have a same height.

(30) The electrical connector of any of configurations (22) through (29), wherein each of the first shell corners have a first height, and each of the second shell corners have a second height different from the first height.

(31) The electrical connector of any of configurations (22) through (30), wherein the wall of the housing has first and second longer sections connected to first and second shorter sections, and the pair of first housing corners are adjacent the first longer section of the wall.

(32) The electrical connector of any of configurations (22) through (31), wherein the shell includes a first section that joins a first of the first shell corners to a first of the second shell corners, the shell includes a second section that joins a second of the first shell corners to a second of the second shell corners, the first section of the shell includes a portion that conforms with the first shorter section of the wall, and the second section of the shell includes a portion that conforms with the second shorter section of the wall.

(33) The electrical connector of any of configurations (22) through (32), wherein the first section of the shell includes a portion that faces a first space corresponding to one of the second portions of the shell, and the second section of the shell includes a portion that faces a second space corresponding to another one of the second portions of the shell.

(34) The electrical connector of any of configurations (22) through (33), wherein a boundary of the first space includes a first one of the pair of second shell corners, and a boundary of the second space includes a second one of the pair of second shell corners.

(35) The electrical connector of any of configurations (22) through (34), wherein each of the first and second sections of the shell includes an upper edge having a curved portion, and a minimum height of the shell at the curved portions is greater than the maximum height of the housing and less than the height of each of the first and second shell corners.

(36) The electrical connector of any of configurations (22) through (35), wherein the shell includes a third section that joins the pair of first shell corners, the shell includes a fourth section that joins the pair of second shell corners, and a height of the third section is greater than the maximum height of the housing.

(37) The electrical connector of any of configurations (22) through (36), wherein the first portions of the shell include a conforming portion that is part of the fourth section of the shell, and a height of the conforming portion of the fourth section of the shell is same as or within 10% of a height of a portion of the wall directly facing the conforming portion.

Methods of mating a plug connector and a receptacle connector according to the technology described herein may be include various processes. Example methods include combinations of processes (38) through (40), as follows:

(38) A method of mating a plug connector and a receptacle connector, the method comprising: aligning the plug connector with the receptacle connector by bringing the plug connector into a region delimited by four corners of a protruding structure extending from a shell of the receptacle connector, the protruding structure having a height corresponding to a maximum height of the receptacle connector, engaging a bar extending from the plug connector with a first space delimited by the shell of the receptacle connector and an outer surface of a first side of a housing wall of the receptacle connector, and engaging a pair of legs extending from the plug connector with a pair of second spaces delimited by the shell of the receptacle connector and an outer surface of a second side of the housing wall of the receptacle connector, wherein the second spaces are located at corners of the shell; and after the aligning, pressing the plug connector towards the receptacle connector, and engaging a plurality of hook portions of the shell with a plurality of notches located at an upper edge of the wall, wherein the first space is located along a first side of the receptacle connector, the second spaces are located along a second side of the receptacle connector opposite to the first side, and the mated position is a single position in which the plug connector aligns with the receptacle connector.

(39) The method of process (38), wherein the pressing of the plug connector towards the receptacle connector is in a direction orthogonal to the housing bottom of the receptacle connector and orthogonal to a cavity bottom of the plug connector.

(40) The method of any of processes (38) through (39), wherein the wall is comprised of the first and second longer wall portions and first and second shorter wall portions, a first section of the shell conforms with the outer surface of the wall at the first shorter wall portion, a second section of the shell conforms with the outer surface of the wall at the second shorter wall portion, after the pressing, a minimum height of the first section of the shell is greater than a maximum height of the housing, and a minimum height of the second section of the shell is greater than the maximum height of the housing.

CONCLUSION

It should be understood that various alterations, modifications, and improvements may be made to the structures, configurations, and methods discussed above, and are intended to be within the spirit and scope of the invention disclosed herein. Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ±20% of a target value in some embodiments, within ±10% of a target value in some embodiments, within ±5% of a target value in some embodiments, and within ±2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

What is claimed is:

1. An electrical connector comprising:

an insulative housing comprising a bottom and a wall bounding, at least in part, an opening adjacent the bottom; and a shell configured to encircle an outer surface of the wall, wherein the shell includes:

a pair of first shell corners configured to conform with a pair of first housing corners of the housing, a height of the first shell corners being greater than a maximum height of the housing, a pair of second shell corners configured to be spaced apart from a pair of second housing corners of the housing in a first direction, a height of the second shell corners being greater than the maximum height of the housing, a plurality of first portions configured to conform with the outer surface of the wall, and a plurality of second portions configured to be spaced apart from the outer surface of the wall.

2. The electrical connector of claim 1, wherein each of the second portions of the shell delimits a space between the outer surface of the wall and the shell, and each of the spaces is configured to receive a portion of a mating connector therein.

3. The electrical connector of claim 2, wherein:

the wall of the housing comprises first and second longer wall portions and first and second shorter wall portions connected to the first and second longer wall portions, the shell comprises first and second longer shell portions facing the first and second longer wall portions, respectively, the first longer shell portion comprises at least one of the first portions conforming with the outer surface of the wall and at least of the second portions spaced apart from the outer surface of the wall, with the at least one of the second portions protruding away from the outer surface of the wall to bound at least one of the spaces, and the spaces are arranged such that the electrical connector has a single mating position with the mating connector.

4. The electrical connector of claim 2, wherein the wall of the housing comprises first and second longer wall portions and first and second shorter wall portions connected to the first and second longer wall portions, at least one of the spaces is located along each of the first and second longer wall portions, respectively, a first section of the shell conforms with the outer surface of the wall at the first shorter wall portion, and a minimum height of the first section is greater than a maximum height of the housing, and a second section of the shell conforms with the outer surface of the wall at the second shorter wall portion, and a minimum height of the second section is greater than the maximum height of the housing.

5. The electrical connector of claim 4, wherein the spaces include a first space located along the first longer wall portion, the first space having a length greater than about half a length of the first longer wall portion in a second direction, and a plurality of second spaces located along the second longer wall portion, each of the second spaces having a length less than about a quarter of a length of the second longer wall portion in the second direction.

6. The electrical connector of claim 5, wherein
the first space is configured to receive a bar-shaped portion of the mating connector, and
each of the second spaces is configured to receive a leg of the mating connector.

7. The electrical connector of claim 1, wherein
the wall of the housing comprises first and second longer wall portions and first and second shorter wall portions connected to the first and second longer wall portions,
at least one of the first portions of the shell and at least one of the second portions of the shell are located along the first longer wall portion, and
at least one of the first portions of the shell and at least one of the second portions of the shell are located along the second longer wall portion.

8. The electrical connector of claim 7, wherein a number of the at least one of the second portions of the shell located along the first longer wall portion is different from a number of the at least one of the second portions of the shell located along the second longer wall portion.

9. The electrical connector of claim 7, wherein a number of the at least one of the first portions of the shell located along the second longer wall portion is different from a number of the at least one of the second portions of the shell located along the second longer wall portion.

10. The electrical connector of claim 1, wherein each of the first and second shell corners have a same height.

11. The electrical connector of claim 1, wherein
each of the first shell corners has a first height, and
each of the second shell corners has a second height different from the first height.

12. The electrical connector of claim 1, wherein
the wall of the housing comprises first and second longer wall portions and first and second shorter wall portions connected to the first and second longer wall portions,
the pair of first housing corners are adjacent the first longer wall portion,
the shell is comprised of a first section that joins a first of the first shell corners to a first of the second shell corners,
the shell is comprised of a second section that joins a second of the first shell corners to a second of the second shell corners,
the first section of the shell includes a portion that conforms with the first shorter wall portion, and
the second section of the shell includes a portion that conforms with the second shorter wall portion.

13. The electrical connector of claim 12, wherein
the first section of the shell includes a portion that faces a first space corresponding to one of the second portions of the shell, and
the second section of the shell includes a portion that faces a second space corresponding to another one of the second portions of the shell.

14. The electrical connector of claim 13, wherein
a boundary of the first space includes a first one of the pair of second shell corners, and
a boundary of the second space includes a second one of the pair of second shell corners.

15. The electrical connector of claim 12, wherein
each of the first and second sections of the shell includes an upper edge having a curved portion, and
a height of the shell at the curved portions is greater than a maximum height of the housing and less than a height of each of the first and second shell corners.

16. The electrical connector of claim 12, wherein
the shell includes a third section that joins the pair of first shell corners,
the shell includes a fourth section that joins the pair of second shell corners, and
a height of the third section is greater than a maximum height of the housing.

17. The electrical connector of claim 16, wherein
the first portions of the shell include a conforming portion that is part of the fourth section of the shell, and
a height of the conforming portion of the fourth section of the shell is same as or within 10% of a height of a portion of the wall of the housing directly facing the conforming portion.

18. The electrical connector of claim 1, further comprising:
an island protruding from the bottom of the housing and into the opening; and
a plurality of terminals supported by the island.

19. The electrical connector of claim 1, wherein the shell is comprised of a plurality of hook portions configured to engage with an edge of the wall of the housing.

20. The electrical connector of claim 19, wherein a height of a portion of the shell on which the hooks portions are located is approximately equal to the maximum height of the housing.

21. The electrical connector of claim 19, wherein the hook portions extend from an upper edge of one or more of the first portions of the shell.

22. The electrical connector of claim 19, wherein the wall of the housing has an edge that includes a plurality of notches configured to engage with the hook portions of the shell.

23. The electrical connector of claim 1, wherein the shell includes a plurality of legs extending away from the housing and configured to engage with a printed circuit board (PCB).

24. The electrical connector of claim 1, wherein:
the wall of the housing comprises first and second longer wall portions and first and second shorter wall portions connected to the first and second longer wall portions,
the pair of first housing corners are adjacent opposite ends of the first longer wall portion,
the shell is comprised of a first section that joins a first of the first shell corners to a first of the second shell corners,
the shell is comprised of a second section that joins a second of the first shell corners to a second of the second shell corners,
the first and second sections of the shell each include an upper portion and a lower portion,
a first of the second shell corners is located at an end of the upper portion of the first section of the shell,
a second of the second shell corners is located at an end of the upper portions of the second section of the shell,
a pair of third shell corners are located at ends of the lower portions of the first and second sections of the shell, respectively,
a first of the third shell corners conforms with a first of the second housing corners, and
a second of the third shell corners conforms with a second of the second housing corners.

25. The electrical connector of claim 24, wherein:
the first shell corners conform with the first housing corners,
the third shell corners conform with the second housing corners, and the second shell corners are spaced apart from the second housing corners such that the second shell corners are cantilevered from the first and second sections of the shell, respectively.

26. The electrical connector of claim 24, wherein a height of the third shell corners is approximately equal to a height of the second housing corners.

27. The electrical connector of claim 24, wherein each of the first and second sections of the shell includes an upper edge having a curved portion, and a height of the shell at the curved portions is greater than a maximum height of the housing and less than a height of each of the first and second shell corners.

28. A method of mating a plug connector and a receptacle connector, the receptacle connector having longer sides and shorter sides, the method comprising:

aligning the plug connector with the receptacle connector by bringing the plug connector into a region delimited by four corners of a protruding structure extending from a shell of the receptacle connector, the protruding structure having a height corresponding to a maximum height of the receptacle connector, engaging a bar extending from the plug connector with a first space delimited by the shell of the receptacle connector and an outer surface of a first side of a housing wall of the receptacle connector, and engaging a pair of legs extending from the plug connector with a pair of second spaces delimited by the shell of the receptacle connector and an outer surface of a second side of the housing wall of the receptacle connector; and after the aligning, pressing the plug connector towards the receptacle connector, and engaging a plurality of hook portions of the shell with a plurality of notches located at an upper edge of the wall, wherein the first space is located along a first longer side of the receptacle connector, the second spaces are located along a second longer side of the receptacle connector opposite to the first side, and the mated position is a single position in which the plug connector aligns with the receptacle connector.

* * * * *